US011719047B2

(12) United States Patent
Russell et al.

(10) Patent No.: US 11,719,047 B2
(45) Date of Patent: Aug. 8, 2023

(54) PROJECTILE DRILLING SYSTEM

(71) Applicant: HYPERSCIENCES, INC., Spokane, WA (US)

(72) Inventors: Mark C. Russell, Spokane, WA (US); Lance D. Underwood, Cypress, TX (US); Leon Vanstone, Austin, TX (US); Parker Bailey, Spokane, WA (US); Desiree Elizabeth Bernhard, Spokane, WA (US); Tristen Cutshall, Spokane, WA (US); Kaito J. Durkee, Spokane, WA (US); Kordell Newberg, Spokane Valley, WA (US); Aaron J. Abeyta, Burien, WA (US)

(73) Assignee: HYPERSCIENCES, INC., Spokane, WA (US)

( * ) Notice: Subject to any disclaimer, the term of this patent is extended or adjusted under 35 U.S.C. 154(b) by 0 days.

(21) Appl. No.: 17/656,133

(22) Filed: Mar. 23, 2022

(65) Prior Publication Data

US 2022/0316277 A1 Oct. 6, 2022

Related U.S. Application Data

(60) Provisional application No. 63/168,133, filed on Mar. 30, 2021.

(51) Int. Cl.
*E21B 7/00* (2006.01)
*E21B 17/18* (2006.01)
(Continued)

(52) U.S. Cl.
CPC ..... *E21B 7/007* (2013.01); *E21B 7/16* (2013.01); *E21B 17/18* (2013.01); *E21B 21/12* (2013.01); *E21B 23/0413* (2020.05)

(58) Field of Classification Search
CPC . E21B 7/007; E21B 7/16; E21B 17/18; E21B 21/12; E21B 23/0413
See application file for complete search history.

(56) References Cited

U.S. PATENT DOCUMENTS 2,544,573 A * 3/1951 Vincent ..... E21B 7/007 175/328
2,621,732 A 12/1952 Ahlgren
(Continued)

FOREIGN PATENT DOCUMENTS

CN 101017076 A 8/2007
CN 101099024 A 1/2008
(Continued)

OTHER PUBLICATIONS

"Drilling and Excavation Technologies for the Future", Committee on Advanced Drilling Technologies, Geotechnical Board/Commission on Engineering and Technical Systems, Board on Earth Sciences and Resources/Commission on Geosciences, Environment, and Resources National Research Council, National Academy Press, Washington, D.C.1994, 176 pages.
(Continued)

*Primary Examiner* — Jonathan Malikasim
(74) *Attorney, Agent, or Firm* — Lindauer Law, PLLC

(57) ABSTRACT

Geologic material in a borehole is weakened by accelerating a projectile into contact with the material. A drill bit is then used to bore through the weakened material. To accelerate the projectile, an endcap is placed in a conduit using a source of gas. The endcap isolates the conduit from the external environment. A projectile is then positioned in the conduit above the endcap. Movable members within the conduit are operated in sequence to enable single endcaps and projectiles to be moved into the conduit. Gas from the conduit is evacuated into an annulus between the conduit and a surrounding conduit, and a propellant material is provided into
(Continued)

the conduit. The propellant material applies a force to the projectile to accelerate the projectile into contact with the geologic material. A fluid is circulated down a second annulus outside of the surrounding conduit to contact the drill bit and remove debris.

28 Claims, 19 Drawing Sheets

(51) Int. Cl.

| | |
|---|---|
| ***E21B 7/16*** | (2006.01) |
| ***E21B 21/12*** | (2006.01) |
| ***E21B 23/04*** | (2006.01) |

(56) References Cited

U.S. PATENT DOCUMENTS

| | | | |
|---|---|---|---|
| 2,913,959 | A | 11/1959 | Mohaupt |
| 3,075,463 | A | 1/1963 | Eilers et al. |
| 3,185,224 | A | 5/1965 | Robinson |
| 3,190,372 | A | 6/1965 | Johnson |
| 3,244,232 | A | 4/1966 | Myers |
| 3,253,511 | A | 5/1966 | Zwicky |
| 3,434,380 | A | 3/1969 | Dardick |
| 3,441,095 | A | 4/1969 | Youmans |
| 3,516,502 | A | 6/1970 | Bennett et al. |
| 3,633,686 | A | 1/1972 | Bennett |
| 3,695,715 | A | 10/1972 | Godfrey |
| 3,855,931 | A | 12/1974 | Dardick |
| 3,863,723 | A | 2/1975 | Godfrey |
| 3,867,867 | A | 2/1975 | Duff |
| 3,979,724 | A | 9/1976 | Silverman et al. |
| 4,004,642 | A | 1/1977 | Dardick |
| 4,030,557 | A | 6/1977 | Mvis et al. |
| 4,063,486 | A | 12/1977 | Ashley |
| 4,106,574 | A | 8/1978 | Dow |
| 4,123,975 | A | 11/1978 | Mohaupt |
| 4,158,388 | A | 6/1979 | Owen et al. |
| 4,467,878 | A | 8/1984 | Ibsen |
| 4,474,250 | A | 10/1984 | Dardick |
| 4,582,147 | A | 4/1986 | Dardick |
| 4,638,712 | A | 1/1987 | Chawla et al. |
| 4,679,637 | A | 7/1987 | Cherrington et al. |
| 4,722,261 | A | 2/1988 | Titus |
| 4,791,850 | A | 12/1988 | Minovitch |
| 4,907,488 | A | 3/1990 | Seberger |
| 4,932,306 | A | 6/1990 | Rom |
| 4,982,647 | A | 1/1991 | Hertzberg et al. |
| 4,997,047 | A | 3/1991 | Schroeder |
| 5,063,826 | A | 11/1991 | Bulman |
| 5,097,743 | A | 3/1992 | Hertzberg et al. |
| 5,098,163 | A | 3/1992 | Young |
| 5,146,992 | A | 9/1992 | Baugh |
| 5,233,903 | A | 8/1993 | Saphier et al. |
| 5,242,025 | A | 9/1993 | Neill et al. |
| 5,421,237 | A | 6/1995 | Naumann |
| 5,487,405 | A | 1/1996 | Skoglund |
| 5,574,244 | A | 11/1996 | Powell et al. |
| 5,578,783 | A | 11/1996 | Brandeis |
| 5,768,940 | A | 6/1998 | Kawaguchi et al. |
| 5,833,003 | A | 11/1998 | Longbottom et al. |
| 5,996,709 | A | 12/1999 | Norris |
| 6,000,479 | A | 12/1999 | Ambs |
| 6,035,784 | A | 3/2000 | Watson |
| 6,457,417 | B1 | 10/2002 | Beal |
| 6,467,387 | B1 | 10/2002 | Espinosa |
| 6,591,731 | B2 | 7/2003 | Goldstein |
| 6,820,697 | B1 | 11/2004 | Churchill |
| 7,069,862 | B2 | 7/2006 | Bassett |
| 7,681,352 | B2 | 3/2010 | Fu et al. |
| 7,775,148 | B1 | 8/2010 | McDermott |
| 7,942,481 | B2 | 5/2011 | Leppänen |
| 8,104,568 | B2 | 1/2012 | Luchini et al. |
| 8,181,561 | B2 | 5/2012 | Riggs et al. |
| 8,302,584 | B1 | 11/2012 | Lu |
| 8,943,970 | B2 | 2/2015 | Greeley |
| 9,103,618 | B2 | 8/2015 | Daniel et al. |
| 9,103,624 | B1 | 8/2015 | Kung et al. |
| 9,169,695 | B1 | 10/2015 | Calvert |
| 9,458,670 | B2 | 10/2016 | Russell |
| 9,500,419 | B2 | 11/2016 | Russell |
| 9,540,895 | B2 | 1/2017 | MacKenzie et al. |
| 9,988,844 | B2 | 6/2018 | Russell et al. |
| 10,132,578 | B2 | 11/2018 | Knowlen et al. |
| 10,329,842 | B2 | 6/2019 | Russell |
| 2001/0045288 | A1 | 11/2001 | Mlamon et al. |
| 2002/0100361 | A1 | 8/2002 | Russell |
| 2005/0034896 | A1 | 2/2005 | Youan |
| 2007/0044963 | A1 | 3/2007 | MacDougall |
| 2007/0186761 | A1 | 8/2007 | Perry |
| 2007/0256826 | A1 | 11/2007 | Ceccarelli et al. |
| 2008/0205191 | A1 | 8/2008 | Coste et al. |
| 2009/0322185 | A1 | 12/2009 | Barnard et al. |
| 2010/0032206 | A1 | 2/2010 | Becker et al. |
| 2010/0133006 | A1 | 6/2010 | Shakra et al. |
| 2010/0180593 | A1 | 7/2010 | Schaller et al. |
| 2010/0284250 | A1 | 11/2010 | Cornish et al. |
| 2011/0114388 | A1 | 5/2011 | Lee et al. |
| 2011/0186377 | A1 | 8/2011 | Kline |
| 2012/0174581 | A1 | 7/2012 | Vaughan et al. |
| 2012/0312545 | A1 | 12/2012 | Suryanarayana et al. |
| 2013/0032337 | A1 | 2/2013 | Rytlewski et al. |
| 2014/0056101 | A1 | 2/2014 | Vu et al. |
| 2014/0133519 | A1 | 5/2014 | Freitag |
| 2014/0158356 | A1 | 6/2014 | Andrzejak et al. |
| 2014/0260930 | A1 | 9/2014 | Russell |
| 2014/0367604 | A1 | 12/2014 | Alexander |
| 2015/0021023 | A1 | 1/2015 | Roberts et al. |
| 2015/0152700 | A1 | 6/2015 | Lovorn et al. |
| 2015/0159478 | A1 | 6/2015 | Georgi et al. |
| 2015/0300327 | A1 | 10/2015 | Sweatman et al. |
| 2015/0330147 | A1 | 11/2015 | Russell |
| 2016/0123081 | A1 | 5/2016 | Russell et al. |
| 2016/0356087 | A1 | 12/2016 | Russell et al. |
| 2017/0130531 | A1 | 5/2017 | Russell |
| 2017/0138128 | A1* | 5/2017 | Russell ..... E21B 7/007 |
| 2018/0017691 | A1 | 1/2018 | Dirksen et al. |
| 2018/0073301 | A1* | 3/2018 | Russell ..... E21B 7/007 |
| 2018/0187542 | A1 | 7/2018 | Sayed et al. |

FOREIGN PATENT DOCUMENTS

| | | | | |
|---|---|---|---|---|
| CN | 102322216 | A | 1/2012 | |
| CN | 102822442 | A | 12/2012 | |
| CN | 103321572 | A | 9/2013 | |
| CN | 102667047 | B | 11/2015 | |
| DE | 2420035 | A1 | 3/1976 | |
| EP | 0663582 | A3 | 11/1995 | |
| EP | 1764577 | A1 | 3/2007 | |
| WO | WO-9603566 | A2 * | 2/1996 | ..... E21B 7/14 |
| WO | 9937878 | A1 | 7/1999 | |
| WO | 2014149173 | A1 | 9/2014 | |
| WO | 2015030730 | A1 | 3/2015 | |
| WO | 2016043723 | A1 | 3/2016 | |

OTHER PUBLICATIONS

Bogdanoff, David W., "New Tube End Closure System for the Ram Accelerator", Journal of Propulsion and Power., vol. 10, No. 4, Jul. 1-Aug. 1994, pp. 518-521.

Fang, et al., "Hypersonic Wave Drag Reduction Performance of Cylinders With Repetitive Laser Energy Depositions", 3rd Int'l Photonics & OptoElectronics Meetings (POEM 2010), Journal of Physics: Conference Series 276 (2011) 012021, IOP Publishing [retrieved on Oct. 20, 2015], Retrieved from http://iopscience.iop.org/article/10.1088/1742-6596/276/1/012021. 8 pages.

Gold, et al., "Concrete Penetration By Eroding Projectiles Experiments and Analysis", Journal of Engineering Mechanics, v122, Feb. 1996, pp. 145-152. Retrieved from the Internet: URL: ascelibrary.org on Feb. 17, 2013.

(56) References Cited

OTHER PUBLICATIONS

Gold, et al., "Constitutive Models for Concrete Penetration Analysis", Journal of Engineering Mechanics, vol. 122, Mar. 1996, pp. 230-238. Retrieved from ascelibrary.org on Feb. 17, 2013,.

Hansen, Viggo, "Ram Accelerator Animation 11", YouTube, Inc., Science and Technology, Published May 2, 2011, Retrieved from the Internet: URL: https://www.youtube.com/watch?v=iFQfOKVi98l.

Lundquist, Robert G., "Underground Tests of The Ream Method of Rock Fragmentation for High-Speed Funneling", Rapid Excavation and Tunneling Conference Proceedings, Ch 56, Mar. 13, 2013, Jan. 1974, pp. 825-840. Retrieved from the Internet: URL: http://www.onemine.org/view/?d=689528D8459E7257609C73381053FBF203FD5CC5A9FC7839952A414670F0591638551.

Schouten, Adri, "Patent Cooperation Treaty International Search Report and Written Opinion dated Jul. 1, 2022", Patent Cooperation Treaty Application No. PCT/US22/71422, Patent Cooperation Treaty, Jul. 1, 2022.

* cited by examiner

PROJECTILE DRILLING SYSTEM

PRIORITY

The present application claims priority to the United States Provisional Patent Application having Application Ser. No. 63/168,133, filed Mar. 30, 2021. Application 63/168,133 is incorporated by reference herein in its entirety.

INCORPORATION BY REFERENCE

The following United States patents and patent applications are incorporated by reference for all that they contain:

U.S. patent application Ser. No. 13/841,236, filed on Mar. 15, 2013, entitled "Ram Accelerator System", now issued as U.S. Pat. No. 9,500,419.

U.S. patent application Ser. No. 14/708,932, filed on May 11, 2015, entitled "Ram Accelerator System with Endcap", now issued as U.S. Pat. No. 9,458,670.

U.S. patent application Ser. No. 14/919,657, filed on Oct. 21, 2015, entitled "Ram Accelerator System with Rail Tube", now issued as U.S. Pat. No. 9,988,844.

U.S. patent application Ser. No. 15/135,452, filed on Apr. 21, 2016, entitled "Ram Accelerator System with Baffles", now issued as U.S. Pat. No. 10,697,242.

U.S. patent application Ser. No. 15/340,753, filed on Nov. 1, 2016, entitled "Projectile Drilling System", now issued as U.S. Pat. No. 10,557,308.

U.S. patent application Ser. No. 15/698,549, filed on Sep. 7, 2017, entitled "Augmented Drilling System", now issued as U.S. Pat. No. 10,590,707.

U.S. patent application Ser. No. 15/348,796, filed on Nov. 10, 2016, entitled "System for Generating a Hole Using Projectiles", now issued as U.S. Pat. No. 10,329,842.

U.S. patent application Ser. No. 15/871,824, filed on Jan. 15, 2018, entitled "System for Acoustic Navigation of Boreholes", now issued as U.S. Pat. No. 10,914,168.

BACKGROUND

Traditional drilling, excavation, and tunneling methods use drills or other boring tools, or in some cases blasting operations, to penetrate through rock or other types of geologic material. Drilling or excavating to form holes is useful in a variety of situations, such as for extracting hydrocarbons, water, or geothermal energy from beneath the earth's surface, forming a tunnel or shaft for mining operations, and so forth. The rate and other characteristics for formation of a borehole may be affected by characteristics of the geologic material, such as the presence of hard rock.

BRIEF DESCRIPTION OF FIGURES

The detailed description is set forth with reference to the accompanying figures.

Figure 1:
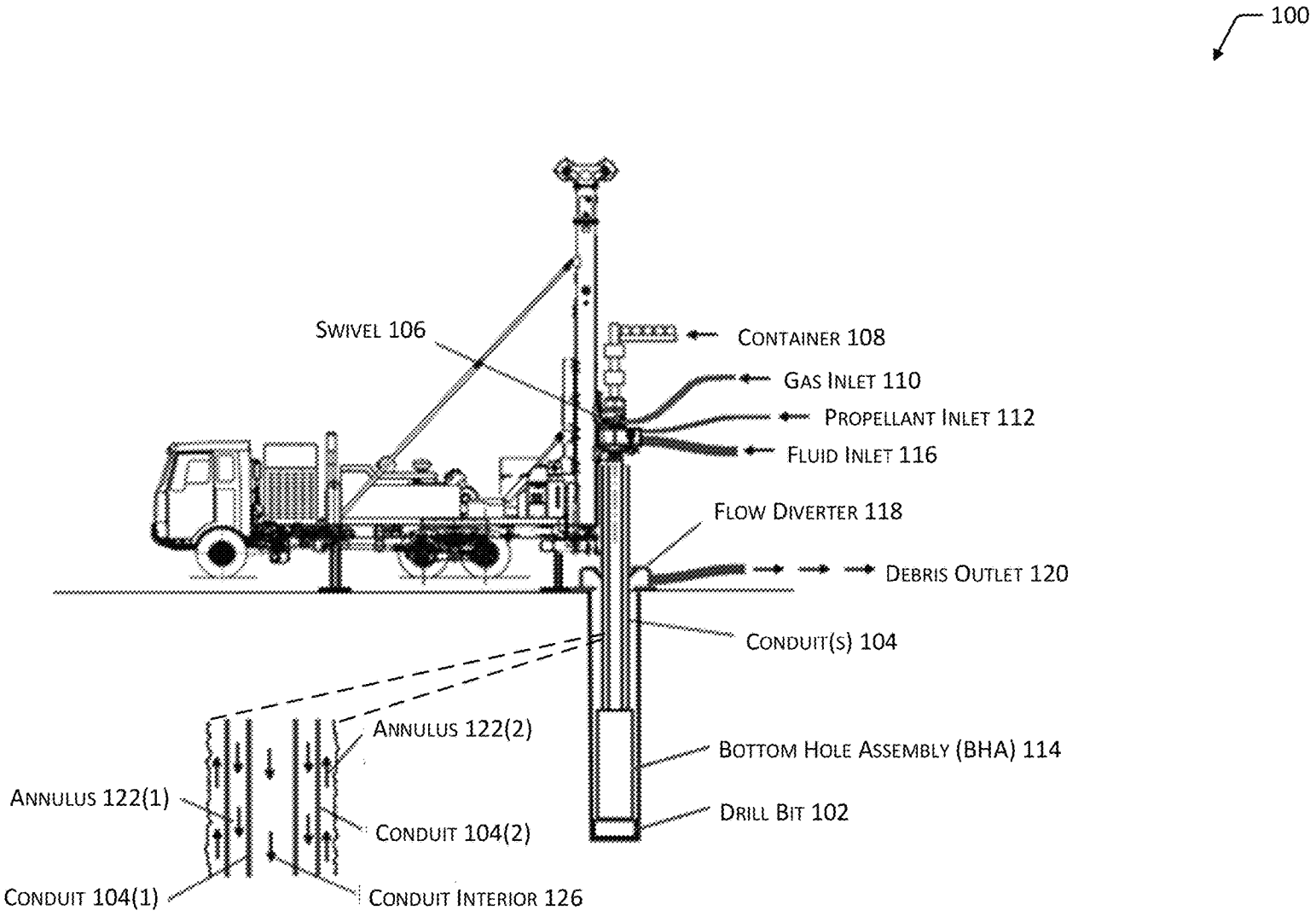
FIG. 1 is a diagram depicting an implementation of a system that may be used to provide endcaps and projectiles into a borehole to be used, in combination with a drill bit, to extend the borehole through geologic material.

While implementations are described in this disclosure by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used in this disclosure are for organizational purposes only and are not meant to be used to limit the scope of the description or the claims. As used throughout this application, the word "may" is used in a permissive sense (i.e., meaning having the potential to) rather than the mandatory sense (i.e., meaning must). Similarly, the words "include", "including", and "includes" mean "including, but not limited to".

DETAILED DESCRIPTION

Drilling in the earth, such as by forming a borehole, shaft, tunnel, or other opening, may be conducted using a variety of tools and methods, such as grinding, crushing, or scraping geologic material. For example, drill bits may be used to form boreholes through geologic material to create hydrocarbon wells, water wells, geothermal wells, and so forth. Drilling operations progress slowly when drilling through hard rock and other materials having a high hardness, which may cause some operations to be inefficient or non-economical. Additionally, drilling operations may subject drill bits and other equipment to significant wear, mechanical forces, high temperatures and pressures, and so forth, which may necessitate frequent maintenance or replacement of various components, further increasing expense and slowing operations.

Described in this disclosure are systems and methods for forming a borehole or other type of opening through geologic material in which a projectile is accelerated into contact with rock, or other geologic material, to remove, destroy, or weaken the material via an impact. In some implementations, a projectile may be propelled through one or more tubes or other conduits by gas that may be generated using a combustion process. The accelerated projectile may achieve a high velocity that may enable the projectile to break or otherwise weaken or degrade the geologic material that is impacted. In some implementations, a ram accelerator assembly may use pressurized gas to accelerate a projectile using a ram effect caused by interaction between exterior features of the projectile and interior features of a tube or other conduit of the ram accelerator assembly. The broken or weakened geologic material may then be contacted with a drill bit, which may penetrate the weakened material more easily, enabling a portion of a borehole to be formed using less time and energy and causing less wear on the drill bit and other components of the system when compared to conventional methods.

A pressure barrier, such as an end cap, may be conveyed down a drilling string or other type of conduit and positioned at or near a terminal end of the conduit. For example, a source of gas, such as air, may be used to convey the endcap. When the endcap is positioned within the conduit, the endcap may isolate the interior of the conduit from an external environment. For example, placement of an endcap may prevent the entry of borehole fluids into the end of the conduit, and may enable the conduit to be maintained at a pressure that differs from that of the environment external to the conduit. A projectile may also be conveyed into the conduit, such as by circulating air or another gas down the conduit. The gas may then be removed from the conduit, such as by venting the gas from the conduit into an annulus external to the conduit, where the gas may flow toward the surface. In other implementations, the gas may be removed from the conduit using a pump, such as an annular pump mounted to the exterior of the conduit. In some implementations, a fluid other than air, a gas, or a gas mixture, such as water, may be used to convey endcaps and projectiles into the conduit, and the fluid may be removed into an adjacent annulus or using a pump.

Propellant material may be provided into the conduit, in some implementations using a fuel line or other type of tube or separate conduit that extends through an annulus adjacent to the conduit. The propellant material may apply a force to the projectile, such as when ignited or combusted, accelerating the projectile through the conduit. When the projectile exits the conduit and contacts geologic material, the geologic material may be weakened, broken, or otherwise degraded. For example, an interaction between the projectile and geologic material may form cracks, weakening the geologic material. In some cases, water or another borehole fluid may fill the cracks that are formed, applying a force to the geologic material that further weakens or breaks the geologic material. In some implementations, a drill bit engaged with the end of the conduit may be used to bore through the weakened or degraded material. Water, drilling mud, or another type of fluid may be conveyed down a separate annulus to contact the drill bit and displace debris formed by interactions between the projectile or drill bit and the geologic material, which may be conveyed to the surface using the fluid. In some implementations, air or another gas conveyed through the conduit may displace cuttings in addition to or in place of water or other fluids. However, in cases of water influx, cuttings may become wet, heavier, clumped, and so forth, and use of water, drilling fluid, or another fluid in addition to or in place of air may be used to displace debris from a borehole.

In some implementations, multiple endcaps and projectiles may be conveyed down the conduit and individually moved into a launch tube, allowing projectiles to be repeatedly accelerated into geologic material during a drilling operation. The resulting system may allow much faster formation of a borehole or other type of opening in geologic material when compared to existing tools and methods, allowing formations with hard rock and other materials having high hardness to be drilled efficiently and economically.

As such, the systems and methods described herein may enable a borehole or other type of opening within geologic material be formed at least partially using impacts from projectiles. Endcaps, projectiles, propellant material, air or another gas, and water or other fluids such as drilling fluid may be provided from a fluid source through a drilling string or other conduit(s) to a bottom hole assembly (BHA), which in some cases may be submerged in water or drilling fluid. The BHA may include features that enable multiple endcaps and projectiles to be provided into the system while protecting the received endcaps and projectiles from damage, controlling the individual placement of endcaps and projectiles, and protecting the endcaps and projectiles from forces such as high pressure shock waves that may occur when a projectile is accelerated or propellant material is combusted. The described systems and methods may also enable a conduit to be at least partially evacuated of air, enabling a projectile and propellant material placed in the conduit to effectively be accelerated into contact with geologic material.

FIG. 1 is a diagram depicting an implementation of a system 100 that may be used to provide endcaps and projectiles into a borehole to be used, in combination with a drill bit 102, to extend the borehole through geologic material. A drilling operation for forming a borehole may utilize a mechanism for hoisting various components, such as a cable-based draw works, hydraulic cylinder, or similar mechanisms. A drilling operation may also use a rotary drive mechanism, such as a mechanical or hydraulic drive system, that conveys rotation to a drill string or other type of conduit(s) 104 within a borehole. Additionally, a drilling operation may include use of a swivel 106, which may include an assembly for providing fluids or other components into the conduit(s) 104, and removing fluids or other components that flow out from the conduit(s) 104. For example, a swivel 106 may include a series of inlets and outlets for providing fluids and other components into a non-rotating body, and transferring the fluids or other components into a rotating body. In some cases, a swivel 106 and rotary drive may be integrated into a single unit, such as a top drive, power swivel, or top head rotary drive. In combination, these components may convey fluids into a drill string or other type of conduit(s) 104 while also transmitting torque to, and lifting or lowering, the conduit(s) 104.

The system 100 shown in FIG. 1 may be used to accelerate projectiles into geologic material, which may weaken, break, or otherwise degrade the geologic material, then contact the weakened geologic material with the drill bit 102 to extend the borehole. The swivel 106 assembly may include multiple inlets and outlets to provide fluids and other materials into, and receive fluids and other materials from, a string of conduit(s) 104. For example, a container 108 that holds one or more endcaps or projectiles may be engaged with the swivel 106 in a manner that endcaps and projectiles from the container 108 may enter the conduit(s) 104 through an inlet. A gas inlet 110 may be used to provide air or another gas into the conduit(s) 104, which may be used to convey endcaps and projectiles through the conduit(s) 104 and in some cases may displace cuttings or other debris formed by interactions between the geologic material and the projectiles or drill bit 102. A propellant inlet 112 may provide propellant material into the conduit(s) 104, which may be used to provide a force to a projectile, such as when ignited or otherwise combusted or actuated, to accelerate the projectile out from the conduit(s) 104 and into contact with geologic material. For example, air, or another gas or gas mixture that includes oxygen may be provided into the gas inlet and through the conduit(s) 104 to a bottom hole assembly BHA 114. The air or other gas may covey an endcap and projectile from the container 108 to the BHA 114. For example, the endcap may seal a portion of the conduit(s) 104 from an environment external to the conduit(s) 104, which may enable an at least partially evacuated state to be achieved by removing at least a portion of the gas from the conduit(s) 104. At least a portion of the air or other gas may be evacuated from the portion of the conduit(s) 104 within the BHA 114, but sufficient air may be retained or provided into the BHA 114 to enable ignition and combustion of propellant material provided using the propellant inlet 112.

After acceleration of the projectile into geologic material, the drill bit 102 may contact the geologic material, extending the borehole. A fluid inlet 116 may be used to provide water, drilling mud, or another fluid into the conduit(s) 104. The fluid may contact the drill bit 102, such as to lubricate or cool the drill bit 102, and may also displace debris formed by interactions between the projectile or drill bit 102 and the geologic material. For example, debris carried out of the borehole by the flow of fluid may pass through a flow diverter 118, where the debris may be communicated to a debris outlet 120, which may include various screens, filters, pits, and so forth for collecting, separating, processing, or transporting the debris. In some implementations, air or another gas provided through the gas inlet 110 may be used in addition to or in place of fluid to remove debris from the borehole.

For example, the swivel 106 may be connected to a drill string or other type of conduit(s) 104. As shown in FIG. 1, in some implementations, the conduit(s) 104 may include an inner first conduit 104(1) and an outer second conduit 104(2) positioned around the inner first conduit 104(1) to define a first annulus 122(1) between the two conduits 104. A second annulus 122(2) may be defined between the exterior of the second conduit 104(2) and the wall of the borehole, or in some implementations, between the exterior of a second conduit 104(2) and a third conduit 104 positioned around the second conduit 104(2). For example, the conduit(s) 104 may include a drill string or other type of string having two or more drill rods, each having at least an inner first conduit 104(1) and an outer second conduit 104(2). The second conduit 104(2) may have threaded connections capable of transmitting torque and sealing against fluid pressure. The first conduit 104(1) may be mounted within the second conduit 104(2) by finned centralizers that center the first conduit 104(1) within the second conduit 104(2). The first conduit 104(1) may have socket-type connections that may be sealed to prevent communication between fluid within the inner conduit 104(1) and fluid in the first annulus 122(1). As such, the inner first conduit 104(1) may convey endcaps, projectiles, and air or another gas to the BHA 114 through the conduit interior 126. Water or drilling fluid may be provided from a fluid source into the conduit(s) 104 through the first annulus 122(1), while debris and the returning fluid may flow toward the surface through the second annulus 122(2), or in other implementations, water or another fluid may be provided into the second annulus 122(2) and return through the first annulus 122(1). In some implementations, a separate conduit 104, such as a fuel line, may be placed in the first annulus 122(1) or second annulus 122(2) and may transport propellant to the BHA 114.

The BHA 114 may house various components and subassemblies that may be used to perform various functions related to acceleration of projectiles, sorting of projectiles and endcaps, selectively introducing projectiles and endcaps into selected portions of the conduit(s) 104, evacuating gas or fluid from the portion of the conduit(s) 104, metering and providing propellant material and air or another gas into the portion of the conduit(s) 104, igniting the mixture of propellant material and air to provide a force to the projectile, and so forth. For example, a portion of the conduit(s) 104 within the BHA 114 may include a breech tube and a launch tube, which may be aligned with an opening that extends through the drill bit 102, enabling projectiles to impact and destroy or degrade geologic material that is in front of the drill bit 102. The drill bit 102 attached to the distal end of the BHA 114 may then be used to provide mechanical cutting action, such as to remove rock or other material near the periphery of the borehole, agitate loose rock cuttings and other debris to facilitate removal of the debris using fluid flow, and so forth.

In some implementations, endcaps and projectiles may be made from frangible materials that are destroyed upon impact, such that debris created by the destroyed endcap and projectiles may be displaced from the borehole by circulating fluid. For example, endcaps and projectile housings may be made from polycarbonate plastic or other high strength plastic material. In some implementations, projectiles may include a dense material such as granite or a composite of high-density materials such as barite or metallic grains, such as hematite or itabirite. In other cases, projectiles may include metallic powders bonded by cement or an organic or inorganic binder, or by a sintering process.

Figure 2:
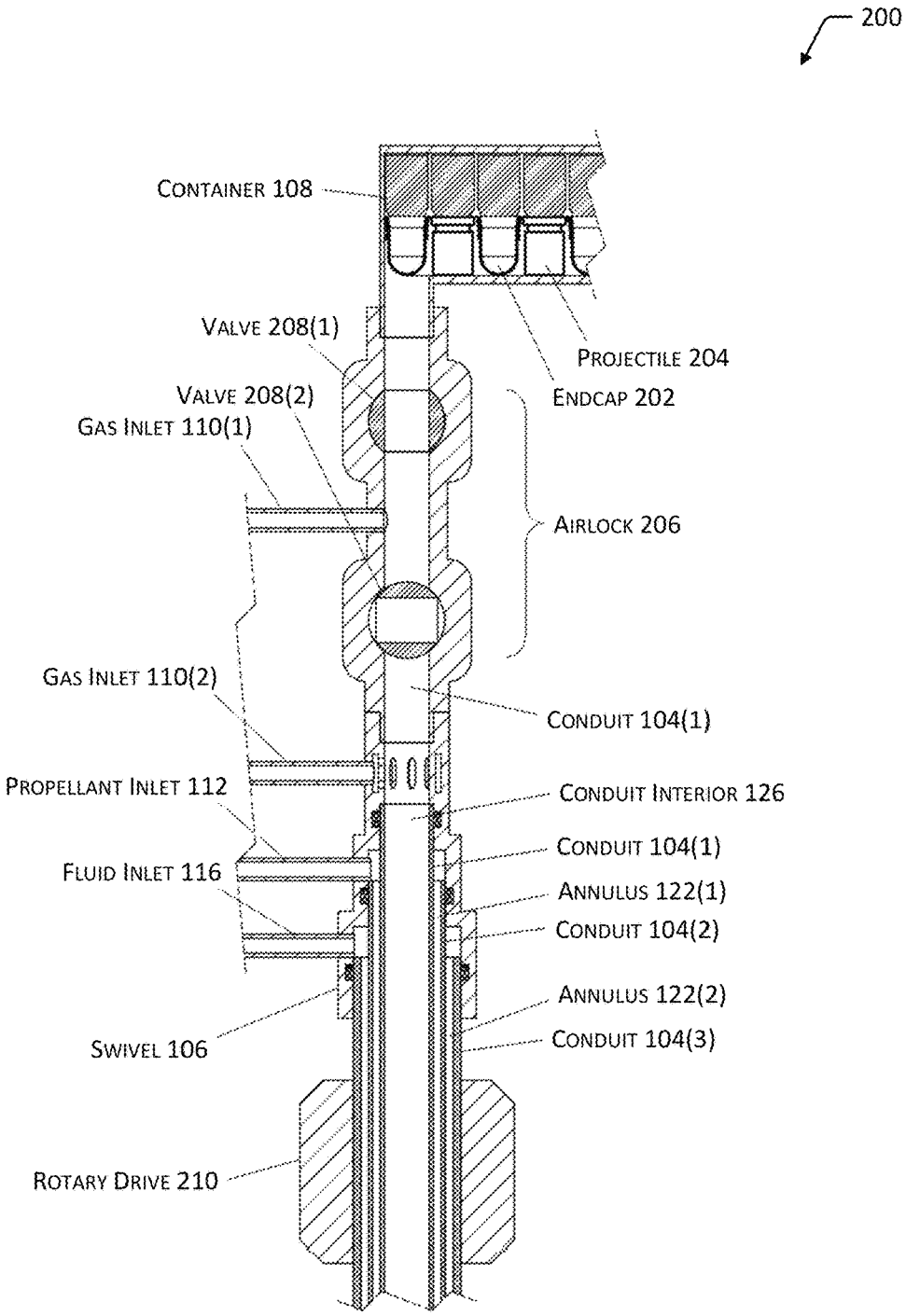
FIG. 2 is a diagram depicting a side cross-sectional view of a swivel assembly and a portion of a conduit used to provide endcaps and projectiles into a borehole.

FIG. 2 is a diagram 200 depicting a side cross-sectional view of a swivel 106 assembly and a portion of a conduit 104 string used to provide endcaps and projectiles into a borehole. The swivel 106 may include a non-rotating body having an inlet passage for providing endcaps 202 and projectiles 204 into the conduit 104 string. The endcaps 202 and projectiles 204 may be arranged in the container 108 in an alternating manner, such that a first endcap 202 is provided into the conduit(s) 104 prior to a first projectile 204. A second endcap 202 may be provided after the first projectile 204, and a second projectile 204 after the second endcap 202, and so forth. Any number of endcaps 202 and projectiles 204 may be provided into the conduit(s) 104 in an alternating manner, enabling an endcap 202 to be positioned to isolate the conduit interior 126 from the environment external to the conduit(s) 104, prior to accelerating a projectile 204 through the conduit(s) 104 to contact geologic material. While FIG. 2 depicts the container 108 as a magazine having a horizontal configuration, in other implementations, endcaps 202 and projectiles 204 may be stored in a container 108 having a vertical orientation. For example, a vertical stack of endcaps 202 and projectiles 204 arranged in an alternating manner may be provided into the conduit 104(1) close-in-time to one another. In still other implementations, the container 108 may be placed on a floor or other surface and may convey endcaps 202 and projectiles 204 to the conduit 104(1) using a tube, hose, or other type of conduit 104 that connects the container 108 to the conduit 104(1). In other cases, endcaps 202 and projectiles 204 may be fed into the airlock 206 using a conveyor system.

The inlet for projectiles 204 and endcaps 202 and one or more gas inlets 110 may connect to the conduit interior 126 of the inner first conduit 104(1). The first conduit 104(1) may be pressurized using air or another gas during drilling operations. The first conduit 104(1) may therefore include an airlock 206 that includes one or more valves 208 to prevent pressurized gas from escaping the conduit 104(1). As shown in FIG. 2, the airlock 206 may include an upstream first valve 208(1) and a downstream second valve 208(2) on opposite sides of an airlock chamber. A first gas inlet 110(1) may connect to the airlock chamber between the valves 208 and may be controlled using an air control valve (not shown). In operation, an endcap 202 or projectile 204 may enter the chamber of the airlock 206 when the first valve 208(1) is open and the second valve 208(2) is closed. The first valve 208(1) is then closed, and air is provided into the airlock 206 using the gas inlet 110(1) to increase the air pressure within the airlock 206. Then, the second valve 208(2) is opened to allow the endcap 202 or projectile 204 to pass from the airlock 206 into the conduit 104(1). The second valve 208(2) may then be closed, enabling the swivel 106 assembly to provide a subsequent endcap 202 or projectile 204 into the airlock 206.

The container 108 and airlock 206 may connect to a housing of the swivel 106. The swivel 106 may be rotationally fixed with respect to one or more components of the system 100, but able to travel in the direction of the axis of the conduit 104 string. The swivel 106 housing and conduit 104(1) may receive endcaps 202, projectiles 204, and air or other gas(ses) from the airlock 206. As described with regard to FIG. 1, the swivel 106 may include a gas inlet 110(2) for providing air or another gas into the inner first conduit 104(1), a propellant inlet 112 for providing propellant material into an annulus 122(1) between the first conduit 104(1) and the second conduit 104(2), and a fluid inlet 116 for providing water or drilling fluid into a second annulus 122(2) between the second conduit 104(2) and a third conduit 104(3). While FIG. 2 depicts the propellant inlet 112 providing propellant material into an annulus 122(1), in other implementations, the propellant inlet 112 may provide propellant material into a fuel line or other type of conduit 104 positioned within the annulus 122(1). The outer third conduit 104(3) may be supported on bearings in the swivel 106 housing which may allow the conduit 104 string to rotate. For example, the outer third conduit 104(3) may be rotatable relative to the swivel 106, and the first conduit 104(1), second conduit 104(2), and third conduit 104(3) may be connected so that the conduits 104 rotate in unison. Continuing the example, the third conduit 104(3) may be connected to a rotary drive 210, such as a chuck mechanism that may grip the outer surface of the third conduit 104(3) and impart rotational force thereto, thereby rotating the conduit 104 string that includes the BHA 114 and drill bit 102. One example rotary drive 210 may include the DR900, made by DR Fabrication of Quebec, Canada. As shown in FIG. 2, the third conduit 104(3) may pass through the center of a chuck mechanism that may grip the third conduit 104(3). In other implementations, the third conduit 104(3) may connect to the rotary drive 210 using a threaded connection or other type of engagement.

While FIG. 2 depicts the swivel 106, inlets, and rotary drive 210 as separate assemblies that are attached to each other, in other implementations, these components may be integrated into a single assembly or two assemblies.

Figure 3:
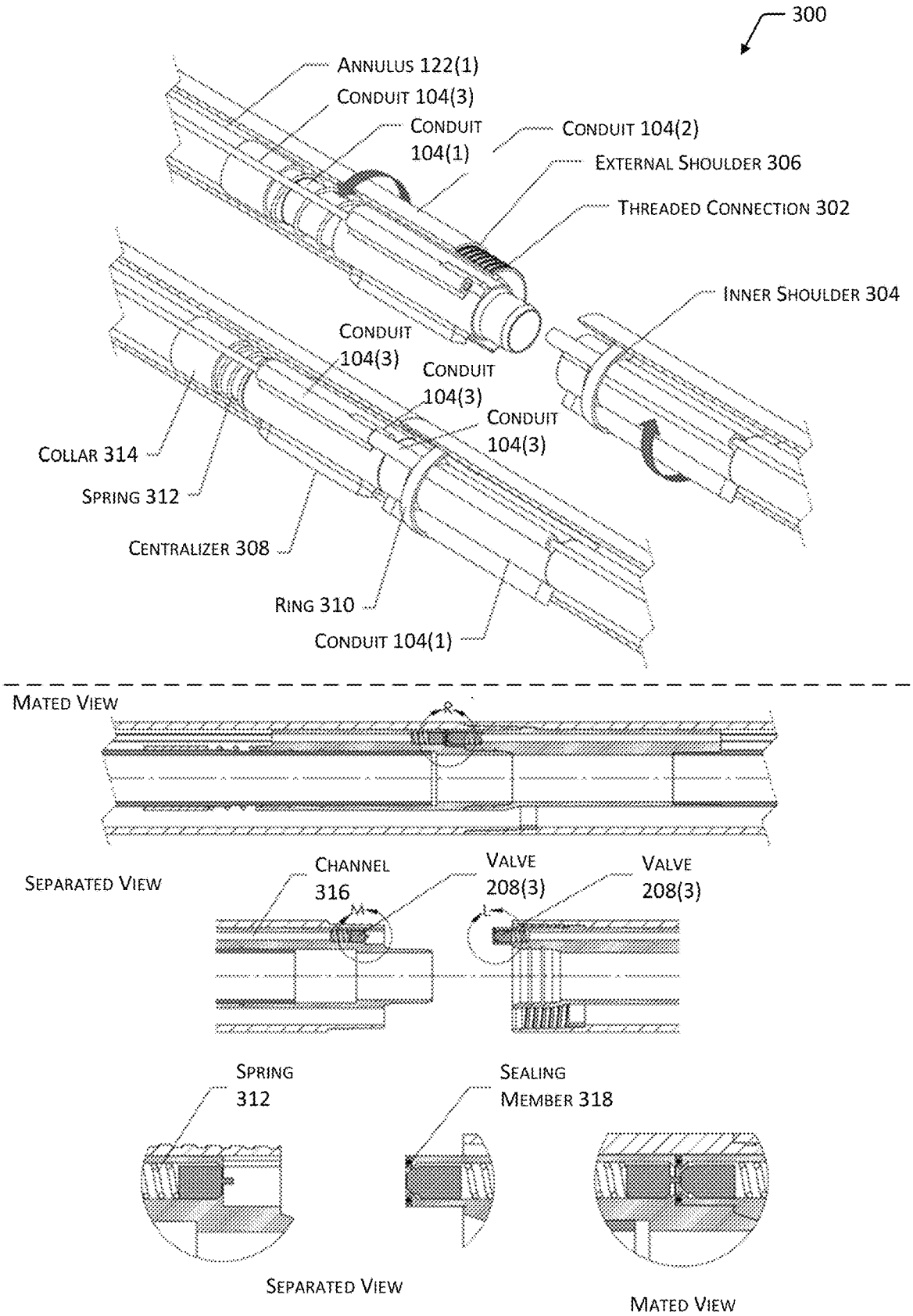
FIG. 3 is a series of diagrams depicting an implementation of conduit assembly that may be used to provide endcaps, projectiles, and other materials into a borehole.

FIG. 3 is a series of diagrams 300 depicting an implementation of a conduit 104 assembly that may be used to provide endcaps 202, projectiles 204, and other materials into a borehole. In some implementations, the conduit 104 assembly may include two or more drill rod assemblies that may be attached to one another, connecting the swivel 106 to the BHA 114. FIG. 3 depicts the conduit 104 assembly including an inner first conduit 104(1) with an outer second conduit 104(2) positioned concentrically around the first conduit 104(1). An annulus 122(1) is positioned between the first conduit 104(1) and second conduit 104(2). In some cases, a third conduit 104(3), such as a fuel line, may be used to transport propellant material to the BHA 114. The third conduit 104(3) may be positioned in the annulus 122(1) between the first conduit 104(1) and second conduit 104(2). In some implementations, the second conduit 104(2) may be similar to a tubular pipe such as an "HXQ drilling-rod", produced by Boart Longyear. For example, one or more of the conduits 104 may be made from high-strength steel (e.g., having a yield strength of 110,000 psi or more).

The outer second conduit 104(2) may include threaded connections 302, such as double-shouldered threaded connections that may hold pressures of 6,000 psi or more and transmitting 3,000 ft-lb of torque or more. The threaded connections 302 may enable the inner diameter and outer diameter of connected segments of conduit 104 to meet in a flush connection. For example, in addition to use of threads, the threaded connections 302 may include an inner shoulder 304 that mates with an external shoulder 306.

The inner first conduit 104(1) may have a fixed end coupling at one end and a floating end coupling at another end. The couplings, or another portion of the first conduit 104(1), may include fins, ribs, or other centralizers 308. In some implementations, one or more rings 310 may be formed on the centralizer(s) 308. For example, a ring 310 may be contained between the inner shoulder 304 and the external shoulder 306 to provide an axial constraint to the first conduit 104(1). In some implementations, the floating end coupling may be biased using a spring 312 and a collar 314. For example, the spring 312 may allow the floating end coupling to move axially and rotationally, but also bias the floating end coupling both axially and rotationally. The collar 314 may be attached to the first conduit 104(1) and may serve as a support for the spring 312. In some implementations, the fixed end coupling may include a first portion of the third conduit 104(3), such as a raised stringer on one side thereof. The floating end coupling may have a second portion of the third conduit 104(3), such as a mating or complementary stringer. One or both of the floating end coupling or the fixed end coupling may include a stringer extension that includes a third portion of the third conduit 104(3). Mating of the fixed end coupling and floating end coupling may also mate the portions of the third conduit 104(3) to form a channel outside of the first conduit 104(1) (e.g., within the annulus 122(1)) that may be used to provide propellant material to the BHA 114.

As shown in the lower portion of FIG. 3, the third conduit 104(3) may include a channel 316 to convey propellant material from a source of propellant material to the BHA 114. In some implementations, the channel 316 may be sealed by a valve 208(3), such as a poppet-type valve. The poppet-type valve may be configured to prevent release of propellant material until the first side of the poppet valve, positioned within a first portion of the third conduit 104(3) engages the mating second side of the poppet valve, positioned within a second portion of the third conduit 104(3). In some implementations, a sealing member 318, such as a face seal or O-ring, may prevent propellant material from leaking from the third conduit 104(3) when both sides of the poppet-type valve are mated. One or both sides of the poppet-type valve may be biased using one or more springs 312 that maintain the poppet-type valve in a closed position until the two sides of the poppet-type valve are mated.

In some implementations, at least a portion of the third conduit 104(3) may include a tube or hose. For example, a flexible conduit 104(3) such as a tube or hose may be spiraled between the two portions of the first conduit 104(1) to allow deflection that may be caused by axial or rotational travel of the first conduit 104(1). In some implementations, the third conduit 104(3) may be attached to the first conduit 104(1) by one or more of brazing, swaging, threaded hydraulic fittings, flare fittings, compression fittings, or ferrule-based fittings, such as those provided by the Swagelok Company, or other types of couplings.

As the threaded connections 302 of the second conduit 104(2) are connected, the floating end coupling of the first conduit 104(1) may rotate. When the portion of the third conduit 104(3) extending form the floating coupling contacts the portion of the third conduit 104(3) on the fixed end coupling, it is prevented from rotating and may move axially toward the other portion of the third conduit 104(3). When the sealing faces of the valve 208(3) come into contact during this process, the valve 208(3) prevents further axial advancement and the spring 312 becomes compressed. The contact force may also cause the sealing member 318 to form a seal. Contact between both sides of a poppet-type valve may allow fluid to flow from one side of the third conduit 104(3) to the other.

As described previously, in some embodiments, an additional conduit 104 may be positioned around the second conduit 104(2). In such a case, the additional conduit 104 may include threaded connections, while the first conduit 104(1) and second conduit 104(2) include socket-type connections. In this implementation, an additional annulus 122(2) is defined between the second conduit 104(2) and third conduit 104(3). In some implementations, a first annulus 122(1) may be used to remove air or another gas from a portion of the conduit interior 126 to the surface, such as by venting gas to ambient pressure at the borehole surface. In other cases, the annulus 122 may vent gas to a sub-ambient pressure zone. For example, gas pressure may be used within the first conduit 104(1) to perform one or more functions, such as combustion of propellant material or to move endcaps 202 and projectiles 204. After an endcap 202 has been placed as a barrier that isolates the conduit interior 126 from the borehole environment, pressure within the conduit 104(1) may be reduce by flowing air into the annulus 122 that communicates with surface pressure, which may reduce the pressure within the conduit 104(1) to approximately atmospheric pressure.

As described previously, the conduits 104 may connect to and deliver gas, propellant material, endcaps 202, projectiles 204, drilling fluid or other fluids, and other materials to a BHA 114.

Figure 4:
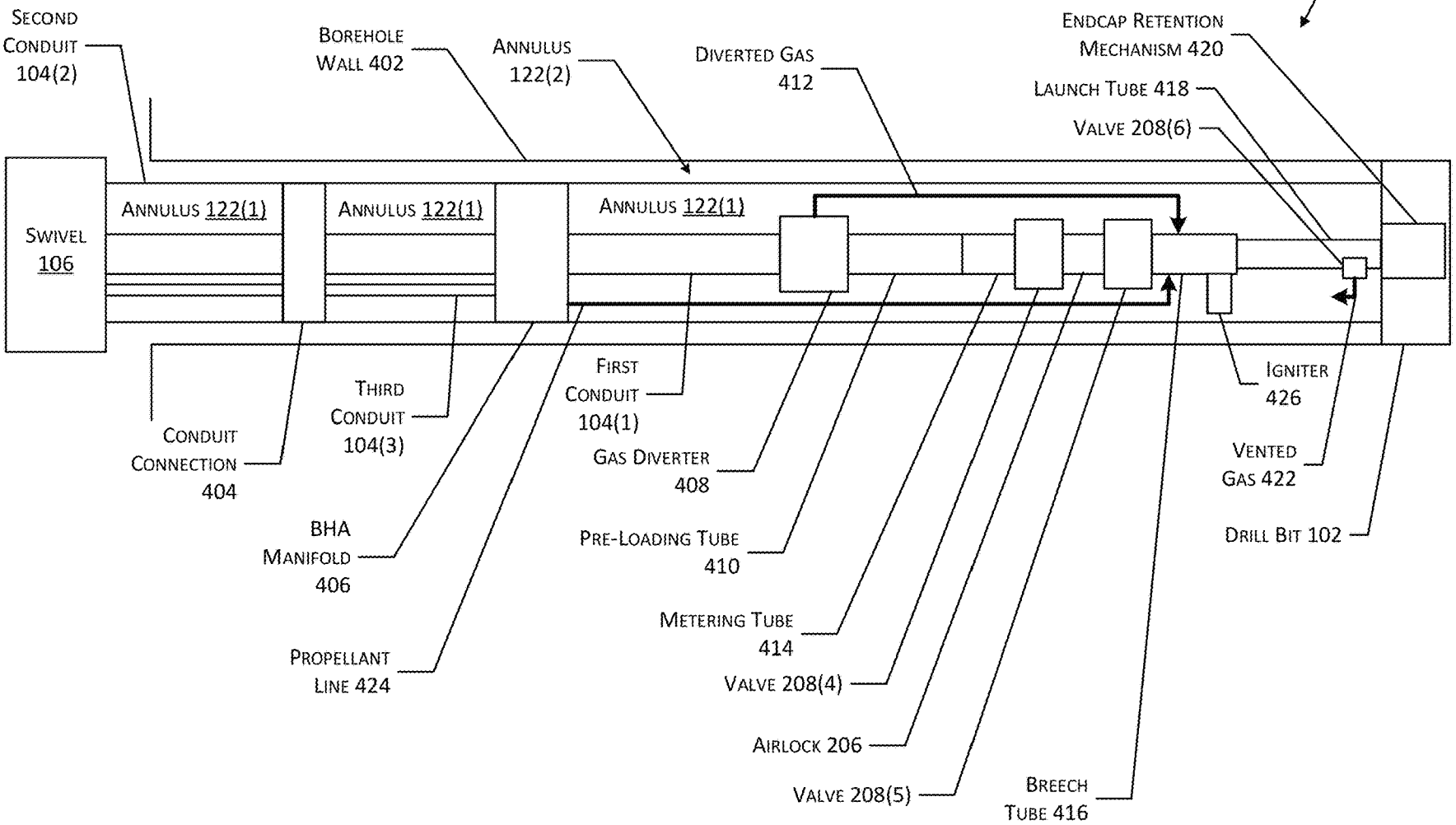
FIG. 4 is a diagram depicting an implementation of a bottom hole assembly (BHA) and an associated string of conduits.

FIG. 4 is a diagram 400 depicting an implementation of a bottom hole assembly (BHA) 114 and an associated string of conduits 104. As described with regard to FIGS. 1 and 2, a swivel 106 located at the surface of a borehole may include one or more inlets for receiving air or another gas which may also receive endcaps 202 and projectiles 204, one or more inlets for receiving propellant material, and one or more inlets for receiving water, drilling fluid, or another fluid. The materials provided into the inlets may flow through a string of conduits 104. Specifically, a first conduit 104(1) may be positioned concentrically within a second conduit 104(2). A first annulus 122(1) may be defined between the first conduit 104(1) and the second conduit 104(2). A second annulus 122(2) may be defined between the second conduit 104(2) and a borehole wall 402. In some implementations, an additional conduit 104 may be positioned concentrically around the second conduit 104(2), and the second annulus 122(2) may be positioned between this additional conduit 104 and the second conduit 104(2). In such a case, an additional annulus 122 may exist between the additional conduit 104 and the borehole wall 402. In some implementations, a third conduit 104(3) may extend axially within the first annulus 122(1). For example, the conduit interior 126 of the first conduit 104(1) may be used to flow air or another gas, endcaps 202, and projectiles 204 toward the BHA 114. The third conduit 104(3) may be used to provide propellant material to the BHA 114. The first annulus 122(1) may be used to provide water or drilling fluid toward the drill bit 102, and the second annulus 122(2) may be used to receive the water or drilling fluid and debris displaced by the fluid. In other implementations, such as when an additional conduit 104 is positioned around the second conduit 104(2), the first annulus 122(1) may be used to flow air that is removed from the BHA 114 toward the surface, while the second annulus 122(2) and an additional annulus 122 may be used to flow water or drilling fluid to and from the drill bit 102.

A conduit connection 404, such as one or more threaded connections, couplings, rings, and so forth, may be used to engage portions of conduits 104 to one another. While FIG. 4 depicts a single conduit connection 404, any number and any type of connection between portions of conduits 104 may be used. One or more of the conduits 104 may engage a BHA manifold 406, which may include one or more inlets, outlets, valves, filters, pumps, and so forth that may control the provision of air or gas, endcaps 202, projectiles 204, propellant material, and water or fluid to the BHA 114. For example, a portion of the first conduit 104(1) extending from the BHA manifold 406 may transport air or another gas, endcaps 202, and projectiles 204 from the BHA manifold 406 past a gas diverter 408, to a portion of the first conduit 104(1) that includes a pre-loading tube 410 where the endcaps 202 and projectiles 204 may be retained. The pre-loading tube 410, depicted and described with more detail with regard to FIG. 5 below, may function as a gas cushion that receives endcaps 202 and projectiles 204 without damage or significant collision between the endcaps 202 and projectiles 204. For example, the flow of gas through the portion of the first conduit 104(1) that includes the pre-loading tube 410 may be prevented or restricted, such as by closing one or more valves 208(4), causing gas from the gas diverter 408 to be diverted around the pre-loading tube 410. A portion of the first conduit 104(1) that includes the metering tube 414, depicted and described in more detail with regard to FIGS. 5 and 6 below, may receive individual endcaps 202 and projectiles 204 from the pre-loading tube 410, such as by actuating movable fingers, latches, or other types of members that protrude into the conduit interior 126. Through actuation of the movable members, an individual endcap 202 or projectile 204 may pass from the pre-loading tube 410 into the metering tube 414. The passage of an additional endcap 202 or projectile 204 into the metering tube 414 may be prevented while actuation of a movable member may enable the endcap 202 or projectile 204 within the metering tube 414 to pass through a first valve 208(4) into an airlock 206. The first valve 208(4) of the airlock 206 may be closed while a second valve 208(5) is opened, to permit the endcap 202 or projectile 204 to pass into a portion of the first conduit 104(1) that includes a breech tube 416.

An endcap 202 within the breech tube 416 may pass into a portion of the first conduit 104(1) that includes a launch tube 418 positioned between the breech tube 416 and the drill bit 102. The endcap 202 may engage an endcap retention mechanism 420, depicted and described with more detail with regard to FIG. 11 below. The endcap retention mechanism 420 may be positioned within or at an end of the launch tube 418 and may include latches, fingers, or other types of movable members that may extend into the conduit interior 126 to contact the endcap 202.

The endcap 202 may isolate the launch tube 418 from the borehole environment. A projectile 204 may then pass from the pre-loading tube 410 through the metering tube 414 and airlock 206 to enter the breech tube 416. At least a portion of the air or other gas within the breech tube 416 and launch tube 418 may the be removed, such as by using one or more valves 208(6) to remove vented gas 422 into an annulus 122(1). In other implementations, an annular pump, depicted and described in greater detail with regard to FIG. 9, may engage the launch tube 418 or another portion of the first conduit 104(1) and may remove gas from within the breech tube 416 and launch tube 418.

A propellant line 424 or a portion of the third conduit 104(3) may provide propellant material from the BHA manifold 406 to the breech tube 416. For example, propellant material may include a combustible material that may apply a force to a projectile 204 within the breech tube 416 to accelerate the projectile 204 through the launch tube 418, through an opening in the drill bit 102, and into contact with geologic material located adjacent to the drill bit 102. In some implementations, the projectile 204 may pass through the endcap 202, at least partially degrading, weakening, or destroying the endcap 202. Diverted gas 412 from the gas diverter 408 may be provided to the breech tube 416 to facilitate ignition or combustion of the propellant material. For example, the diverted gas 412 may include air or another gas having sufficient oxygen to enable ignition or combustion of the propellant material. Continuing the example, an igniter 426 associated with the breech tube 416 may ignite or otherwise initiate combustion of the propellant material.

Various components of the BHA 114 shown in FIG. 4 may be actuated using electrical or hydraulic valves. For example, drilling fluid or another separate hydraulic fluid may be used to actuate valves that control a pump that controls transport of propellant material from the BHA manifold 406 to the breech tube 416, valve actuators to control the valves 208 of the airlock 206, valve actuators to control one or more valves 208 that regulate the flow of gas from the gas diverter 408 to the breech tube 416, valves 208 for removing gas from the launch tube 418, and so forth. Electrical or hydraulic valves or other controls may also be used to control the movable members within the metering tube 414 and endcap retention mechanism 420.

For example, drilling fluid or another fluid from the swivel 106 may be conveyed to the BHA 114 via various circuits in the string of conduits 104. Drilling fluid or other fluids may be recirculated, filtered using shakers, hydrocyclones, centrifuges, screens, and the like, and in some cases, one or more downhole filters within the BHA 114 or string of conduits 104 may be used to filter the fluid, remove debris, and so forth. Drilling fluid may exit through jets or nozzles associated with the drill bit 102 and circulate toward the surface through an annulus 122. For example, pressure within the BHA 114 that is greater than pressure in the annulus 122 may be used to move fluid through jets or nozzles to the annulus 122. In some cases, a portion of the fluid may be diverted for use controlling valves 208 to regulate the release of gas, propellant material, water or drilling fluid, and so forth. For example, valves 208 may be selectively opened to release drilling fluid or water, air or another gas, and so forth to flush the breech tube 416 and launch tube 418, to remove debris after acceleration of a projectile 204, to place an endcap 202 within the launch tube 418, to place a projectile 204 within the breech tube 416, to fill the breech tube 416 with propellant material and gas for combustion, and so forth.

In some implementations, the BHA 114 may include a control system that may control relays, solenoids, servos, servo motors, or other control mechanisms. The control system may receive inputs from sensors, such as a flow switch, pressure relay or transducer, temperature transducer or thermocouple, limit switch, proximity or position switch or transducer, resistivity sensor, ultrasonic sensor, or other sensors that may provide inputs indicative of the status of the system 100. Inputs from the sensors may be used by the controller to provide signals to various components based on logic embedded in the controller. For example, pressure may be sensed to determine when the breech tube 416 has reached an amount of pressure appropriate for acceleration of a projectile, a limit switch or proximity sensor may determine that an endcap 202 or projectile 204 has entered or exited an airlock 206, an ultrasonic sensor may determine whether an object within an airlock 206 is an endcap 202 or projectile 204, a limit switch or position transducer may identify whether a valve 208 is open or closed, a pressure sensor, proximity sensor, or limit switch may determine whether an endcap 202 has reached a selected position within the launch tube 418, a flow switch may indicate whether the system 100 is ready for use or should be placed in a non-operation mode, and so forth.

The controller may include a microprocessor or programmable logic controller (PLC), which may control functions such as opening and closing of valves 208, actuation of the igniter 426 to ignite a propellant material and cause acceleration of a projectile 204, and so forth. The controller may be housed in a sealed pressure chamber or other type of housing that is isolated from borehole fluids by high pressure feedthrough connectors that may pass sensor inputs and control signals into and from the housing. In some implementations, the control system may be powered by a battery or other type of power source that may be housed in the pressure chamber or other type of housing associated with the BHA 114. In other implementations, power may be provided using a generator within the BHA 114, a turbine driven by drilling fluid, a battery that is recharged by or supplemented by a downhole generator, and so forth.

In some implementations, the system 100 may be associated with a hydraulic control system that uses hydraulic fluid, rather than drilling fluid or another fluid provided using inlets in the swivel 106, to actuate valves and perform other functions. For example, hydraulic fluid may be stored in a downhole reservoir, pumped using one or more downhole pumps powered by electrical power or a downhole turbine, circulated through the system 100 and recirculated to the reservoir, and so forth.

In some implementations, the propellant material may include diesel or another hydrocarbon, which may be pressurized by a pump associated with the BHA 114 to a pressure sufficient for combustion, such as a pressure ranging from 5000 to 30000 psi, depending on downhole temperature. The propellant material may be injected into the breech tube 416 at or proximate to the time that air or another diverted gas 412 is released into the breach tube 416 to facilitate mixing of the propellant material with the gas. In some implementations, a combination of downhole and surface pumps may be used to provide propellant material into the breech tube 416. For example, the downhole pump may provide most of the pressure for injection of the propellant material, while a pump at the surface is used to overcome the fluid friction of pumping the propellant material through the third conduit 104(3). Continuing the example, the pressure required at the surface to overcome fluid friction may range from 300 to 3000 psi depending on the size of the third conduit 104(3) and the depth of the borehole. In other implementations, greater pressure may be applied using one or more pumps at the surface of the borehole. In some implementations, one or more additives may be added to the propellant material to enhance combustion, reducing the atomization requirement and reducing the pressure required to do so.

In other implementations, propellant materials may include, without limitation, hydrogen, propane, butane, liquid fuels (such as hydrocarbons, etc.), a solid gas generator that may produce propellant or oxidizer, or explosive materials. For example, one implementation may utilize air as an oxidizer and another gas as propellant material, such as hydrogen. Other implementations may use propellant materials or oxidizers that are liquids under pressure but gaseous at ambient conditions within the embodiment, such as propane or butane as propellant material, nitrous oxide as an oxidizer, and so forth. In some implementations, a compressed liquid may be incorporated into one or more projectiles 204, and the portion of a projectile 204 that includes the material may be punctured or otherwise accessed to release the material as a gas. In another implementation, a solid gas generator may be incorporated within the body of a projectile 204, or supplied in line with an endcap 202 or projectile 204. The solid gas generator, upon activation, may generate propellant material, which in some cases may limit or eliminate the need for a third conduit 104(3) or propellant line 424. In other implementations, a solid gas generator may produce an oxidizer for use in combination with propellant material, limiting or eliminating the need to provide air or another oxidizing gas into the breech tube 416. In still other implementations, solid explosives may be used to accelerate projectiles 204, which may limit or eliminate the need to provide propellant material or gas into the breech tube 416. Explosive material may be included within the body of a projectile 204, or provided separately into the breech tube 416.

Figure 5:
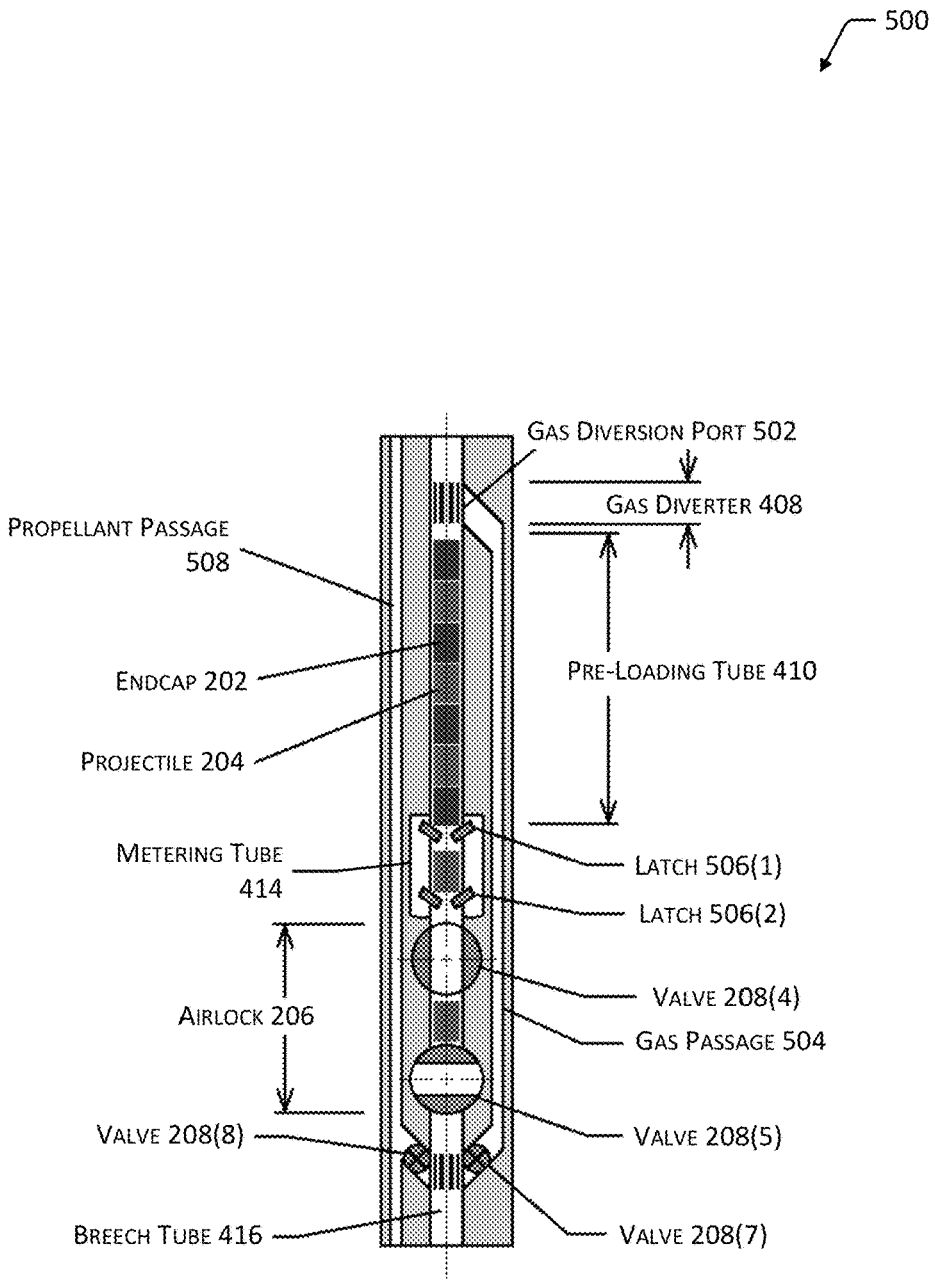
FIG. 5 is a diagram depicting an implementation of a gas diverter, pre-loading tube, metering tube, and airlock within a bottom hole assembly (BHA).

FIG. 5 is a diagram 500 depicting an implementation of a gas diverter 408, pre-loading tube 410, metering tube 414, and airlock 206 within a bottom hole assembly (BHA) 114. As described previously, endcaps 202 and projectiles 204 may be provided from the swivel 106 to the BHA 114 via a first conduit 104(1), such as by using air or another gas to move the endcaps 202 and projectiles 204 through the first conduit 104(1) to a pre-loading tube 410. In some cases, the velocity of the endcaps 202 and projectiles 204 within the first conduit 104(1), when propelled using a stream of gas, may be sufficient to potentially damage or destroy the endcaps 202 or projectiles 204. In such a case, the pre-loading tube 410 may be used to limit or prevent damage to the endcaps 202 and projectiles 204, such as by slowing the objects as they reach and enter the pre-loading tube 410. For example, the gas diverter 408 may divert gas that is used to move the endcaps 202 and projectiles 204, using a gas diversion port 502. Diverted gas 412 may be flowed through a gas passage 504 that flows from the gas diverter 408 to the breech tube 416, bypassing the airlock 206, thereby conveying air or another gas for use in the BHA 114. The gas diverter 408 may include screens, filters, or other barriers that prevent endcaps 202 or projectiles 204 from entering or becoming caught on the entrance to the gas passage 504. Therefore, endcaps 202 and projectiles 204 may pass the gas diversion port 502 and enter the pre-loading tube 410. The pre-loading tube 410 may include a generally cylindrical passage that holds at least one endcap 202 or projectile 204, but in some implementations, may hold ten or more endcaps 202 and projectiles 204. Storing multiple endcaps 202 and projectiles 204 within the pre-loading tube 410 may enable the feeding of endcaps 202 and projectiles 204 from the surface to be independent of the times at which projectiles 204 are accelerated to extend the borehole. The pre-loading tube 410 may limit or prevent damage to endcaps 202 and projectiles 204 by functioning as a gas cushion, such as a blind cavity having generally small clearance between the outer diameter of the endcaps 202 and the inner diameter of the pre-loading tube 410, enabling air within the pre-loading tube 410 and the limited clearance to slow the movement of endcaps 202 and projectiles 204.

To facilitate maintaining the pre-loading tube 410 as a blind cavity, an airlock 206 that controls the flow of gas beyond the preloading tube 410 may be used. The airlock 206 may include an upper first valve 208(4) and a lower second valve 208(5) on opposite sides of an airlock chamber. In operation, at least one of the valves 208 associated with the airlock 206 may be closed at a given time. The first valve 208(4) may primarily withstand a pressure differential from above, such as pressure from portions of the conduit 104(1) above the valve 208(4) being greater than pressure below the valve 208(4). The second valve 208(5) may at least partially limit the flow of gas between the airlock 206 and the breech tube 416. However, gas that passes through the second valve 208(5) may be removed from the breech tube 416 and launch tube 418 using a valve 208(6) (shown in FIG. 4) to vent the gas into an annulus 122(1), or using an annular pump.

In one implementation, gas pressure may be used to move an endcap 202 to isolate the launch tube 418 from the borehole environment. In such a case, gas pressure from air moved through the first conduit 104(1) may be greater than drilling fluid pressure at the drill bit 102, which may be based in part on the hydrostatic pressure in the borehole and the rate at which drilling fluid returns to the surface via an annulus 122. For example, if a borehole has a depth of 1000 meters, fluid pressure at the drill bit 102 may be approximately 3000 psi. In such a case, at times when the breech tube 416 and launch tube 418 are at least partially evacuated by removing gas therefrom, gas pressure above the airlock 206 may therefore be 3000 psi or more. At times when the first valve 208(4) is open and the second valve 208(5) is closed, and the breech tube 416 and launch tube 418 are at least partially evacuated, the pressure differential across the second valve 208(5) may be 3000 psi or greater. However, when a projectile 204 is accelerated, such as through combustion of propellant material, pressure below the second valve 208(5) may increase. For example, acceleration of a projectile 204 may result in pressures of 10000 psi or greater below the second valve 208(5). In some implementations, the first valve 208(4) may be unidirectional (e.g., capable of sustaining pressure from one direction), while the second valve 208(5) is bidirectional (e.g., capable of sustaining pressure from both directions).

While FIG. 5 depicts an airlock 206 that includes two valves 208, in other implementations, the airlock 206 may include three valves 208. For example, an uppermost valve 208 and a middle valve 208 may be unidirectional, each oriented to withstand greater pressure from above. The lower valve 208 may be unidirectional, oriented to withstand greater pressure from below. In such a case, the upper and middle valves 208 may be configured to withstand lower pressures than a single valve that performs the same function, such as for example 4000 psi, while the lower valve 208 may be configured to withstand a greater pressure, such as 12000 psi. In such a case, the lower valve 208 may protect the upper and middle valves 208 from transient increases in pressure that may occur when a projectile 204*r* is accelerated. Because the torque used to actuate a ball valve increases with the pressure rating of the valve, use of two valves 208 configured to withstand lower pressures may decrease the torque required to actuate the valves 208, which may reduce the requirements of the valve actuation components of the system 100.

While FIG. 5 depicts the valves 208 as ball valves, in other implementations, one or more of the valves 208 may include flapper valves, or other types of valves able to fit within the string of conduits 104 and withstand the pressures within the conduits 104.

As described with regard to FIG. 4, a metering tube 414 may be located below the pre-loading tube 410 and above the airlock 206 to enable movement of a single endcap 202 or projectile 204 from the pre-loading tube 410 into the airlock 206. The metering tube 414 may include a first latch 506(1) or set of latches positioned on a first side of the metering tube 414 proximate to the pre-loading tube 410, and a second latch 506(2) or set of latches positioned on a second side of the metering tube 414 proximate to the airlock 206. A propellant passage 508 may extend through the BHA 114 past the gas diverter 408, which may be used to provide water, drilling fluid, or another fluid to the drill bit 102, or in some implementations, to receive gas vented from the launch tube 418. Downstream of the airlock 206, one or more control valves, such as a valve 208(7) for controlling the flow of gas from the gas passage 504 into the breech tube 416, and a valve 208(8) for controlling the flow of fluid or other materials from the propellant passage 508 into or from the breech tube 416, may be used. Selective opening and closing of the control valves may allow gas or drilling fluid to enter the breech tube 416 and protect upstream conduits 104 from exposure to high pressure during combustion of propellant material to accelerate a projectile 204.

Figure 6A:
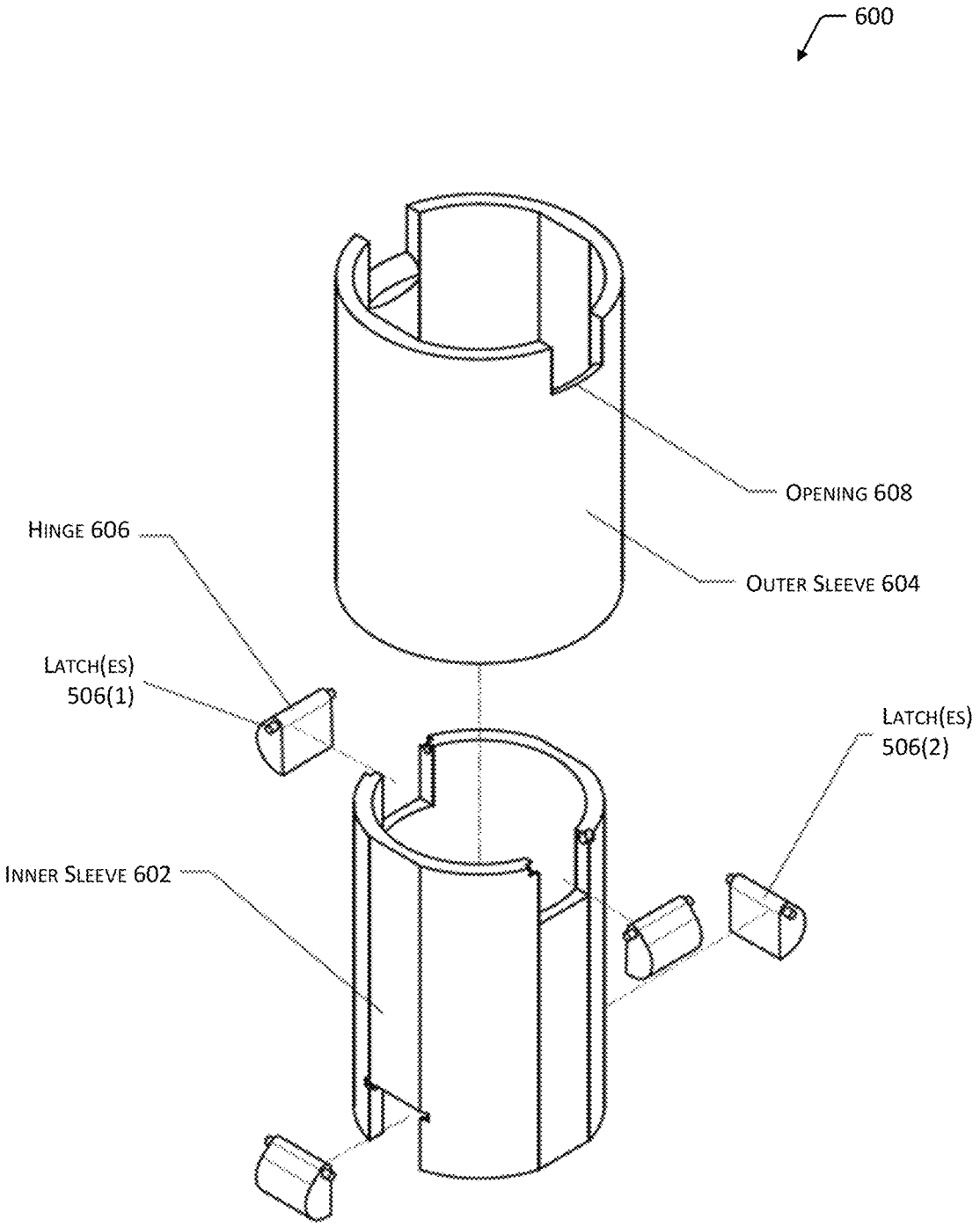
FIG. 6A is a diagram depicting an isometric disassembled view of an implementation of a metering tube within a bottom hole assembly (BHA).

FIG. 6A is a diagram 600 depicting an isometric disassembled view of an implementation of a metering tube 414 within a bottom hole assembly (BHA) 114. As described previously, the metering tube 414 may sequentially operate latches 506 to enable a single endcap 202 or projectile 204 to pass from the pre-loading tube 410 into the metering tube 414, then from the metering tube 414 into the airlock 206 and ultimately into the breech tube 416. The metering tube 414 may include an inner sleeve 602 positioned within an outer sleeve 604. A set of upper first latches 506(1) may engage a first end of the inner sleeve 602 using a hinge 606 or other type of mechanism that may enable the latches 506(1) to move between a first position that at least partially obstructs the interior of the inner sleeve 602 and a second position that does not obstruct the interior or obstructs the interior less than when in the first position. A set of lower second latches 506(2) may engage a second end of the inner sleeve 602 and may also be movable between a first position that at least partially obstructs the interior of the inner sleeve 602 and a second position. Mounting of the sets of latches 506 on hinges 606 enables the latches 506 to be actuated (e.g., moved toward the first position to at least partially obstruct the inner sleeve 602), by movement of the outer sleeve 604 relative to the inner sleeve 602. For example, moving the outer sleeve 604 upward relative to the inner sleeve 602 may actuate the first latches 506(1), which may protrude into the interior of the metering tube 414 through openings 608 in the sleeves. Moving the outer sleeve 604 downward relative to the inner sleeve 602 may actuate the second latches 506(2), while enabling the first latches 506(1) to at least partially retract from the interior of the metering tube 414.

When actuated to protrude into the interior of the metering tube 414, a set of latches 506 may restrain movement of endcaps 202 and projectiles 204 through the string of conduits 104. In some implementations, one of the first latches 506(1) or second latches 506(2) may be actuated at a given time, while the other set of latches 506 is de-actuated. In other implementations, depending on the spacing between the openings 608 within the sleeves, both sets of latches 506 may be actuated at the same time. While FIG. 6A depicts two latches 506 within each set, any number of latches 506 may be used, including a single latch 506 or more than two latches 506. Additionally, while FIG. 6A depicts the latches 506 secured using hinges 606, in other implementations, any mechanism that enables movement of a latch 506 into and out from the interior of the metering tube 414 may be used, including without limitation pins, cams, tracks, gears, pistons, or collet. Further, while FIG. 6A depicts an outer sleeve 604 that moves axially relative to an inner sleeve 602 to actuate the latches 506, in other implementations, the other sleeve 604 may move rotationally relative to the inner sleeve 602, or other mechanisms such as cams, linkages, push rods, gears, pistons, hydraulic actuators, and so forth may be used to move the latches 506.

Figure 6B:
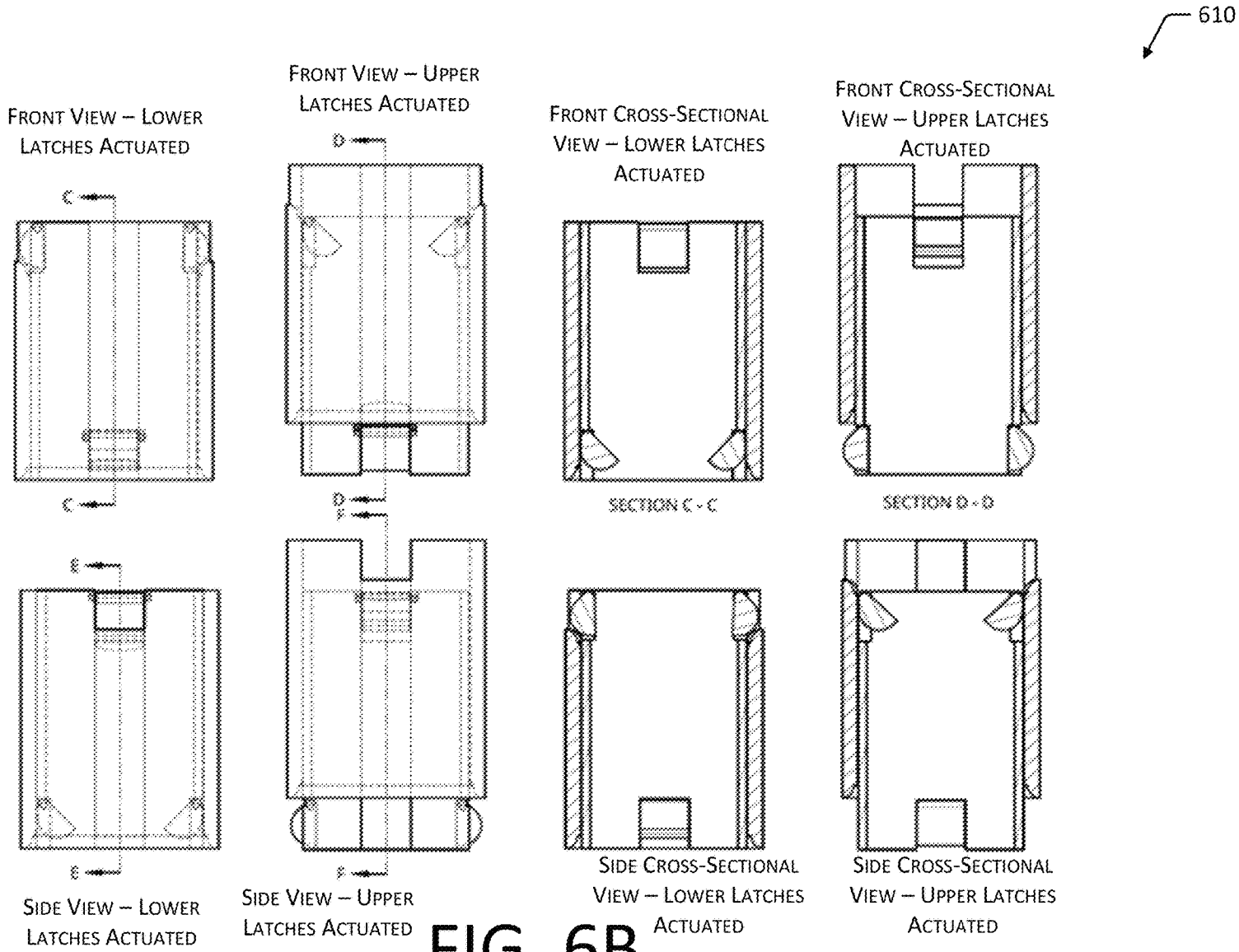
FIG. 6B is a series of diagrams depicting side and cross-sectional views of the metering tube of FIG. 6A in upper and lower actuated positions.

FIG. 6B is a series of diagrams 610 depicting side, front, and cross-sectional views of the metering tube 414 of FIG. 6A in upper and lower actuated positions. For example, one sequence by which the metering tube 414 may be operated may include the following:

A series of alternating endcaps 202 and projectiles 204 within the pre-loading tube 410 are restricted from movement into the metering tube 414 by the actuated upper latches 506(1). FIG. 6B depicts four views of the metering tube 414 that depict the actuated upper latches 506(1), labeled "Front View—Upper Latches Actuated", "Side View—Upper Latches Actuated", "Front Cross-Sectional View—Upper Latches Actuated", and "Side Cross-Sectional View—Upper Latches Actuated".

The upper latches 506(1) may then be de-actuated while the lower latches 506(2) are actuated. In other implementations, the lower latches 506(2) may be in an actuated position prior to de-actuation of the upper latches 506(1). In some cases, the upper latches 506(1) and lower laches 506(2) may be configured such that de-actuation of one set of latches 506 causes actuation of the other, and vice versa, so that both sets of latches 506 are not de-actuated at one time. De-actuation of the upper latches 506(1) may enable an endcap 202 to enter the metering tube 414 from the pre-loading tube 410. FIG. 6B depicts four views of the metering tube 414 that depict the actuated lower latches 506(2), labeled "Front View—Lower Latches Actuated", "Side View—Lower Latches Actuated", "Front Cross-Sectional View—Lower Latches Actuated", and "Side Cross-Sectional View—Lower Latches Actuated".

The lower latches 506(2) may then be de-actuated to allow the endcap 202 to move toward the closed upper valve 208(4). The upper latches 506(1) may be actuated to prevent passage of a projectile 204 into the metering tube 414. The upper valve 208(4) of the airlock 206 may then be opened to allow the endcap 202 to enter the airlock 206. The upper valve 208(4) may then be closed, separating the airlock 206 that contains the endcap 202 from the metering tube 414.

The upper latches 506(1) may be de-actuated, and the lower latches 506(2) may be actuated, to allow a projectile 204 to enter the metering tube 414 to contact the lower latches 506(2). The lower latches 506(2) may then be de-actuated to permit the projectile 204 to move toward the airlock 206, while the upper latches 506(1) are actuated to prevent a subsequent endcap 202 from entering the metering tube 414. Further movement of the projectile 204 may be prevented by the closed upper valve 208(4) of the airlock 206.

The lower valve 208(5) may be opened to release the endcap 202 into the breech tube 416, and the endcap 202 may move into the launch tube 418 to engage the endcap retention mechanism 420. The endcap 202 may isolate the interior of the launch tube 418 from the borehole environment.

The lower valve 208(5) of the airlock 206 may be closed and the upper valve 208(4) of the airlock 206 may be opened to enable passage of the projectile 204 into the airlock 206. The lower valve 208(5) may be opened to enable passage of the projectile 204 into the breech tube 416. The valve 208(6) in the launch tube 416 may be actuated to remove gas from the breech tube 416 and launch tube 418. In other implementations, one or more pumps may be used to remove gas from the breech tube 416 and launch tube 418. Propellant material and diverted gas 412 may then be provided into the breech tube 416, and combustion of the propellant material may apply a force to the projectile 204 that accelerates the projectile 204 toward the endcap 202, then out from the launch tube 418 to contact geologic material. The drill bit 102 may be used to bore through material weakened by contact with the projectile 204.

The process described with regard to FIG. 6B may be repeated for multiple endcaps 202 and projectiles 204 that are provided into the pre-loading tube 410, enabling generally continuous acceleration of projectiles into contact with geologic material.

Figure 7:
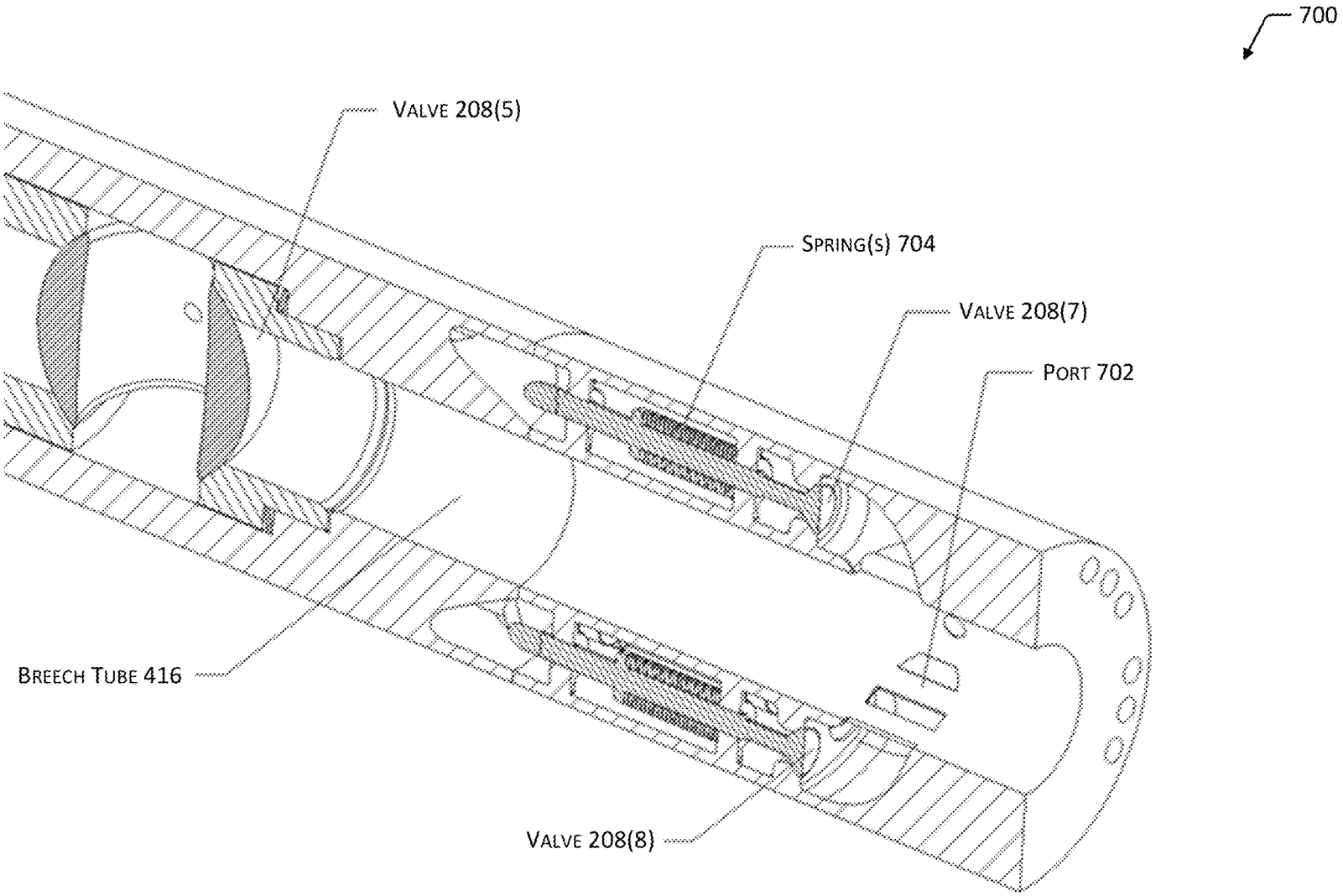
FIG. 7 is a diagram depicting an isometric cross-sectional view of one implementation of a configuration of valves within a breech tube.

FIG. 7 is a diagram 700 depicting an isometric cross-sectional view of one implementation of a configuration of valves 208 within a breech tube 416. As described previously with regard to FIG. 5, one or more valves 208 may be used to selectively introduce diverted gas 412 from a gas diverter 408 or fluid from a propellant passage 508 into the breech tube 416, or to the drill bit 102. In the implementation shown in FIG. 7, two control valves 208(7), 208(8) for moving gas or fluid into or from the breech tube 416 are shown, however in other implementations, other numbers of valves 208 may be used. In some implementations, valves 208 may be driven by a pushrod that is driven by a piston, actuated with hydraulic pressure by a solenoid or servo mechanism.

A first valve 208(7) that separates a gas passage 504 from the breech tube 416 may be used to control the flow of air or another gas into the breech tube 416, such as to facilitate ignition and combustion of a propellant material. Air or another gas may also be flowed into the breech tube 416 to flush the breech tube 416 or launch tube 418 of cuttings or other debris that may have flowed into the launch tube 418 or breech tube 416 after acceleration of a projectile 204. Air or another gas may additionally be flowed into the breech tube 416 to move an endcap 202 through the breech tube 416 toward the endcap retention mechanism 420.

A second valve 208(8) that separates the propellant passage 508 from the breech tube 416 may be used to control the flow of water, drilling fluid, or one or more other fluids into the breech tube 416. Fluids that pass through the second valve 208(8) may be used to flush the breech tube 416 or launch tube 418 of cuttings or other debris in a manner similar to that described with regard to the first valve 208(7).

The first valve 208(7) and second valve 208(8) may be closed, and one or more other valves 208(6) may be opened to at least partially evacuate the breech tube 416 and launch tube 418 after positioning an endcap 202 and projectile 204. Valves 208 may also be opened to provide propellant material into the breech tube 416.

The port 702 that connects the first valve 208(7) and second valve 208(8) to the breech tube 416 may be constructed having openings smaller than endcaps 202 or projectiles 204, such as to prevent endcaps 202 or projectiles 204 from partially entering the port 702 or becoming caught on edges thereof. For example, FIG. 7 depicts the port 702 having a shape that includes multiple vertical openings.

As described with regard to the valves 208 associated with the airlock 206, control valves associated with the breech tube 416 may be configured to retain upstream air or fluid pressure when the breech tube 416 is in an at least partially evacuated state. For example, pressure above the valves 208 may range from 2000 to 3000 psi higher than the pressure below the valves 208. However, when a projectile 204 is accelerated by combusting propellant material, pressure within the breech tube 416 may reach 10000 psi or more. Therefore, in some implementations, the valves 208 may be configured so that a higher pressure in the breech tube 416 may drive the valves 208 in a direction that causes sealing contact pressure on the valve seats to be higher. The valves 208 may be biased by springs so that adequate valve seat contact pressure exists during acceleration of projectiles 204. For example, FIG. 7 depicts the first valve 208(7) and second valve 208(8) biased using one or more springs 704, such as disc springs or Belleville springs. However, in other implementations, other types of springs such as coil springs, or other types of biasing members may be used.

Figure 8:
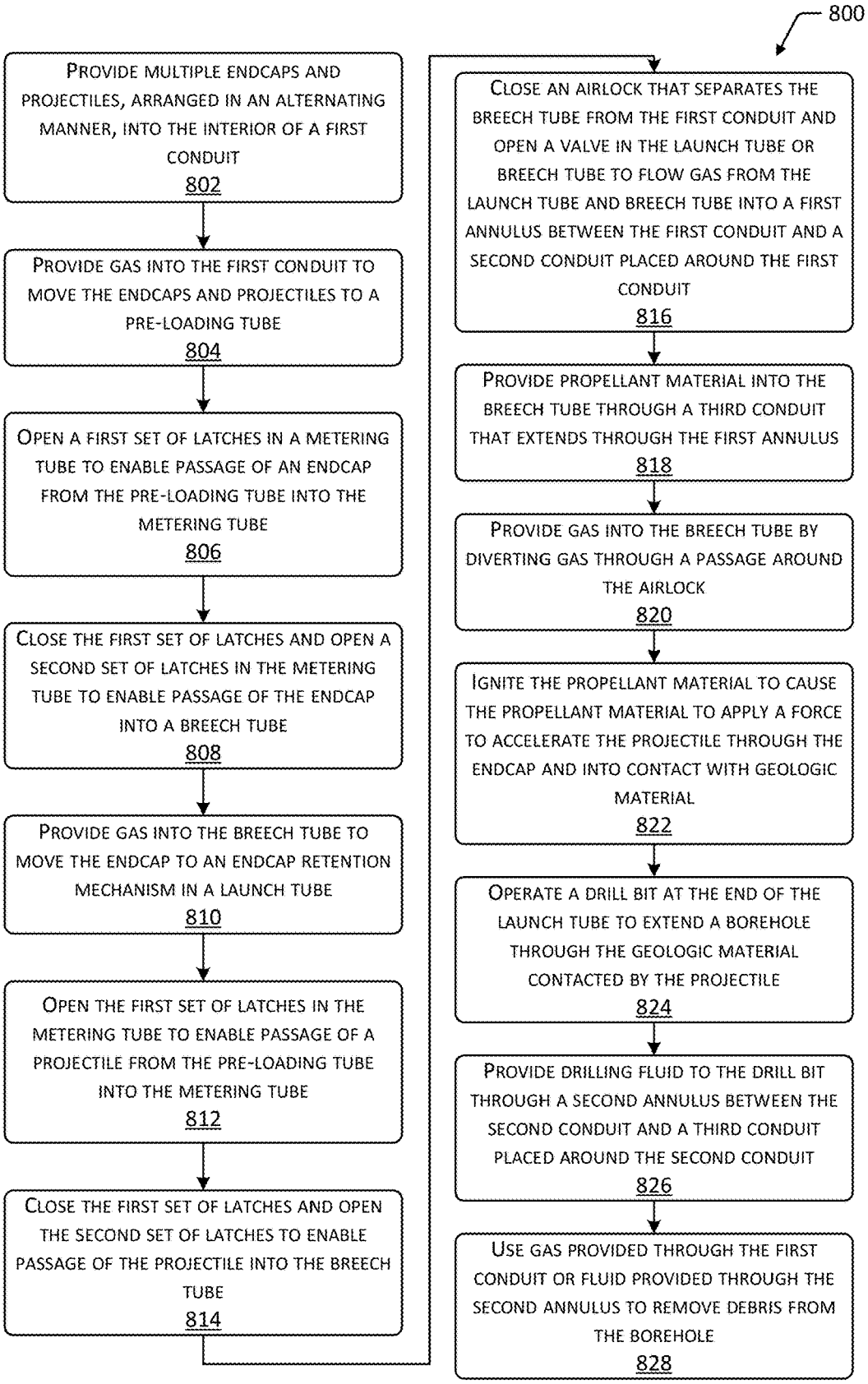
FIG. 8 is a flow diagram depicting an implementation of a method for providing an endcap, projectile, and propellant material into a conduit string and using the projectile and a drill bit to extend a borehole.

FIG. 8 is a flow diagram 800 depicting an implementation of a method for providing an endcap 202, projectile 204, and propellant material into a conduit string and using the projectile 204 and a drill bit 102 to extend a borehole. At block 802, multiple endcaps 202 and projectiles 204, arranged in an alternating manner, may be provided into the interior of a first conduit 104(1). As described with regard to FIG. 2, a container 108 that holds one or more endcaps 202 and projectiles 204 that are arranged in an alternating manner may be placed in communication with an inlet within a swivel 106 assembly. The container 108 may have a horizontal orientation, such as that shown in FIG. 2, from which individual endcaps 202 and projectiles 204 may be sequentially provided into the conduit 104(1). In other implementations, the container 108 may have a vertical orientation and multiple endcaps 202 and projectiles 204 may be provided into the conduit 104(1) close-in-time. In still other implementations, the container 108 may be positioned on the ground or another surface near the swivel, and a hose or other conduit may communicate endcaps 202 and projectiles 204 into the conduit 104(1).

At block 804, gas may be provided into the first conduit 104(1) to move the endcaps 202 and projectiles 204 to a pre-loading tube 410. For example, the swivel 106 assembly may include a gas inlet 110(2) that may be used to provide air or another gas from a gas source into the interior of the first conduit 104(1). The flow of gas may be used to move endcaps 202 and projectiles 204 through the conduit 104(1) toward the pre-loading tube 410. As described with regard to FIG. 5, one or more valves 208(4) may separate the pre-loading tube 410 from the breech tube 416, while gas is diverted through a gas passage 504 around the valve(s) 208(4), enabling the pre-loading tube 410 to function as an air cushion that may prevent damage to the endcaps 202 and projectiles 204 by slowing movement of the endcaps 202 and projectiles 204.

At block 806, a first set of latches 506(1) in a metering tube 414 adjacent to the pre-loading tube 410 may be opened to enable passage of an endcap 202 from the pre-loading tube 410 to the metering tube 414. As described with regard to FIGS. 5 and 6, the endcap may contact a second set of latches 506(2) and be retained in the metering tube 414, while the projectile 204 that follows the endcap 202 in the pre-loading tube 410 is prevented from further advancement through the conduit 104(1). In some implementations, the second set of latches 506(2) and first set of latches 506(1) may operate in conjunction with one another, such that de-actuation of one set of latches 506 causes actuation of the other, and vice versa. For example, FIG. 6 depicts an implementation in which sets of latches 506 are actuated by movement of an outer sleeve 604 relative to an inner sleeve 602. In other implementations, the sets of latches 506 may be operated independently, such as through use of hydraulic or other methods of actuation.

At block 808, the first set of latches 506(1) may be closed and the second set of latches 506(2) may be opened to enable passage of the endcap 202 into the breech tube 416. Closure of the first set of latches 506(1) may prevent advancement of the projectile 204 that follows the endcap 202 while the endcap 202 is moved into the breech tube 416. As described with regard to FIG. 5, in some implementations, the endcap 202 may pass through an airlock 206 that is positioned between the metering tube 414 and the breech tube 416.

At block 810, gas may be provided into the breech tube 416 to move the endcap 202 to an endcap retention mechanism 420 within a launch tube 418. As described with regard to FIGS. 5 and 7, control valves 208 may be operated to control the flow of gas around the airlock 206 and into the breech tube 416 to provide movement to the endcap 202. As described with regard to FIG. 4, the endcap retention mechanism 420 may be positioned within or at an end of the launch tube 418 and may include latches, fingers, or other types of movable members that may extend into the conduit 104(1) to contact the endcap 202. The endcap retention mechanism 420 is depicted and described with more detail with regard to FIG. 11 below.

At block 812, the first set of latches 506(1) in the metering tube 414 may be opened to enable passage of the projectile 204 that follows the endcap 202 from the pre-loading tube 410 into the metering tube 414. The second set of latches 506(2) may be closed and may prevent further movement of the projectile 204 toward the breech tube 416. The body of the projectile 204 may prevent further advancement of a subsequent endcap 202 into the metering tube 414.

At block 814, the first set of latches 506(1) may be closed and the second set of latches 506(2) may be opened to enable passage of the projectile into the breech tube 416. Closure of the first set of latches 506(1) may prevent further advancement of a subsequent endcap 202 toward the breech tube 416 while the projectile 204 is moved into the breech tube 416. As described with regard to FIG. 5, the projectile 204 may pass through an airlock 206 between the metering tube 414 and the breech tube 416. As described with regard to block 810, gas provided into the breech tube 416 may also move the projectile 204 to a selected position, such as at or near the junction of the breech tube 416 and the launch tube 418.

At block 816, the airlock 206 that separates the breech tube 416 from the upper portion of the first conduit 104(1) may be closed, and a valve 208(6) in the launch tube 418 or breech tube 416 may be opened to flow gas from the launch tube 418 and breech tube 416 into a first annulus 122(1) between the first conduit 104(1) and a second conduit 104(2) placed around the first conduit 104(1). As described with regard to FIGS. 1, 2, and 4, in some implementations, the breech tube 416 and launch tube 418 may be at least partially evacuated by removing gas into the first annulus 122(1). For example, the first annulus 122(1) may communicate with the surface of the borehole, and placing the breech tube 416 and launch tube 418 in communication with surface pressure may enable the higher pressure within the breech tube 416 and launch tube 418 to equalize with the surface pressure. The valve 208(6) may be closed after removing gas from the breech tube 416 and launch tube 418. In other implementations, the gas in the breech tube 416 and launch tube 418 may be at least partially evacuated before moving the projectile 204 into the breech tube 416, such as after the projectile 204 has moved into the airlock 206. Gas may be removed from the breech tube 416 and launch tube 418 any time after the end cap 202 has isolated the launch tube 418 from the borehole environment and the breech tube 416 is isolated from the remainder of the conduit string such as by closing one or more valves 208.

At block 818, propellant material may be provided into the breech tube 416 through a third conduit 104(3) that extends through the first annulus 122(1). For example, as shown in FIGS. 3 and 4, a third conduit 104(3) may axially extend within the first annulus 122(1) between the first conduit 104(1) and second conduit 104(2) and may provide propellant material from a source of propellant material to the breech tube 416. As described with regard to FIGS. 5 and 7, one or more valves 208 may control the flow of propellant material into the breech tube 416.

At block 820, gas, such as air or another gas that includes oxygen, may be provided into the breech tube 416 by diverting the gas through a passage around the airlock 206. For example, as described with regard to FIG. 5, a gas diverter 408 may flow gas around the pre-loading tube 410, metering tube 414, and airlock 206 into the breech tube 416. A valve 208(7) between a gas passage 504 that connects the gas diverter 408 to the breech tube 416 may be used to control the flow of gas to the breech tube 416. The gas provided to the breech tube 416 may be used to facilitate combustion of propellant material to accelerate the projectile 204. For example, the gas may include air or another gas that includes sufficient oxygen for a combustion reaction.

At block 822, the propellant material may be ignited, which may cause the propellant material to apply a force to accelerate the projectile 204 through the launch tube 418 and endcap 202 into contact with geologic material. As described previously, the propellant material may be mixed with air within the breech tube 416 to enable a combustion reaction to be initiated, such as by actuating an igniter 426. The reaction of the propellant material may accelerate the projectile 204 through the launch tube 418. In some implementations, the launch tube 418 may include one or more interior features that impart a ram effect as the projectile 204 is accelerated, such as interior baffles, rails, or other features. The projectile 204 may at least partially destroy or weaken the endcap 202 as the projectile 204 passes through the endcap 202. The projectile 204 may pass through an opening in the drill bit 102 to contact geologic material. The geologic material contacted by the projectile 204 may be at least partially weakened, degraded, broken, and so forth. The projectile 204 may be at least partially destroyed by the interaction between the projectile 204 and the geologic material. Therefore, the interactions between the projectile 204 and endcap 202, and between the projectile 204 and geologic material may create debris that may include portions of the endcap 202, projectile 204, and geologic material.

At block 824, the drill bit 102 at the end of the launch tube 418 may be operated to extend a borehole through the geologic material contacted by the projectile 204. The geologic material that was weakened by the interaction with the projectile 204 may be penetrated more easily using the drill bit 102, reducing the energy and mechanical wear associated with operation of the system 100, and enabling the borehole to be extended at a faster rate than conventional techniques. Interactions between the drill bit 102 and geologic material may generate additional debris.

At block 826, drilling fluid may be provided to the drill bit 102 through a second annulus 122(2) between the second conduit 104(2) and a third conduit 104 that is placed around the second conduit 104(2). The drilling fluid may include an oil-based or water-based drilling fluid. In other implementations, water may be used in addition to or in place of the drilling fluid. The drilling fluid may contact the drill bit 102, such as to cool and lubricate the drill bit 102. The drilling fluid may also displace cuttings and other debris within the borehole.

At block 828, gas provided through the first conduit 104(1), or fluid provided through the second annulus 122(2), may be used to remove debris from the borehole. For example, after removal of the endcap 202 by the projectile 204, air or another gas may be provided through the first conduit 104(1), which may exit the distal end of the launch tube 418 and displace debris. The displaced debris may be carried out of the borehole through the first annulus 122(1). Alternatively or additionally, drilling fluid provided into the borehole through the second annulus 122(2) may displace debris into a third annulus between the outermost conduit 104 and the borehole wall 402, or in some cases an additional conduit 104.

Figure 9A:
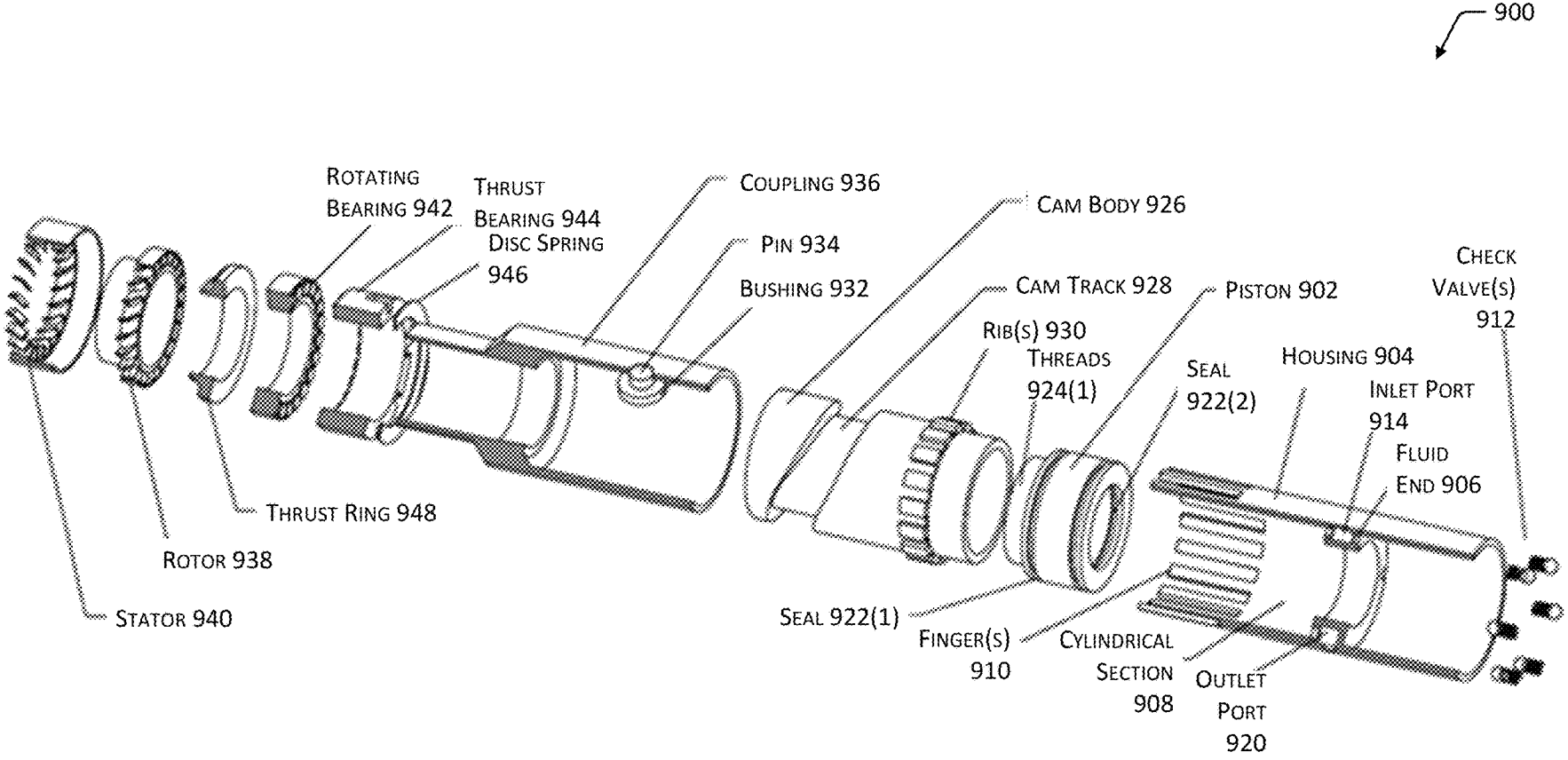
FIG. 9A is a diagram depicting an exploded partial cross-sectional view of an implementation of a pump that may be used to remove gas or fluid from a breech tube or launch tube.

FIG. 9A is a diagram 900 depicting an exploded, partial cross-sectional view of an implementation of a pump that may be used to remove gas or fluid from a breech tube 416 or launch tube 418. While FIG. 4 describes use of a valve 208(6) that may move gas from the breech tube 416 and launch tube 418 into an annulus 122(1), in some implementations, an annular pump may be used to remove gas or fluid from the breech tube 416 and launch tube 418. The pump may include an annular piston 902 that may reciprocate in a piston housing 904. The piston housing 904 may include a fluid end 906, cylindrical section 908, and anti-rotation fingers 910. While the anti-rotation fingers 910 are shown as open-ended fingers 910, in other implementations, the pump may include other anti-rotation features, such as a spline within a cylinder, or other mechanisms that allow axial motion while preventing rotational motion of a mating component.

The fluid end 906 may include one or more check valves 912, or other types of valves. One or more of the check valves 912 may connect to the launch tube 418 through at least one inlet port 914. The check valve(s) 912 and inlet port 914 may allow gas or fluid to flow from ports in the launch tube 418 into the fluid end 906 of the pump. One or more of check valves 912, or other types of valves, may be used to control the flow of fluid between the BHA 114 and an adjacent annulus 122, through an associated outlet port 920 of the pump.

In some implementations, the annular piston 902 may have one or more seals 922(1) on an outer diameter thereof, which may seal against the cylindrical section 908, and one or more seals 922(2) on an inner diameter thereof, which may seal against the outer diameter of the launch tube 418. In other implementations, the piston 902 may include piston rings, such as rings formed from a ceramic material or hard metal, such as tungsten carbide, or may be made from or coated with such materials. In such a case, the piston 902 may function using only a single seal 922, or no sealing members.

The annular piston 902 may be attached, such as by use of threads 924(1), to a cam body 926 that includes a cam track 928 about its circumference. The cam body 926 may include one or more splines, ribs 930, or other types of protrusions that may enable the cam body 926 to move in an axial direction but prevent rotation thereof. In some implementations, the cam track 928 may have a machined shape, such as a shape corresponding to a sine wave, so that acceleration at each end of a stroke cycle for the pump is minimized. In some implementations, the cam body 926 may include multiple parts, that may be attached to one another, such as by use of threads 924(2) (shown in FIG. 9B) that are proximate to a shoulder 925 (shown in FIG. 9B) to provide a stop when the parts are threaded together. In some cases, the parts may be threaded together prior to machining the cam track 928 to enable opposing faces of the cam track 928 to be separated, then assembled around a mating component.

The pump may include a roller drive bushing 932 mounted on an axle pin 934, on a rotating coupling 936 that may be driven by a turbine or other source of motive force. For example, a turbine that drives the pump may be a multi-stage, axial flow turbine, similar to those that may be used to power downhole turbodrills. While such a turbine may include 100 or more turbine stages, FIG. 9A depicts a single example turbine rotor 938, stator 940, rotating bearing 942, thrust bearing 944, disc spring 946, and thrust ring 948.

Figure 9B:
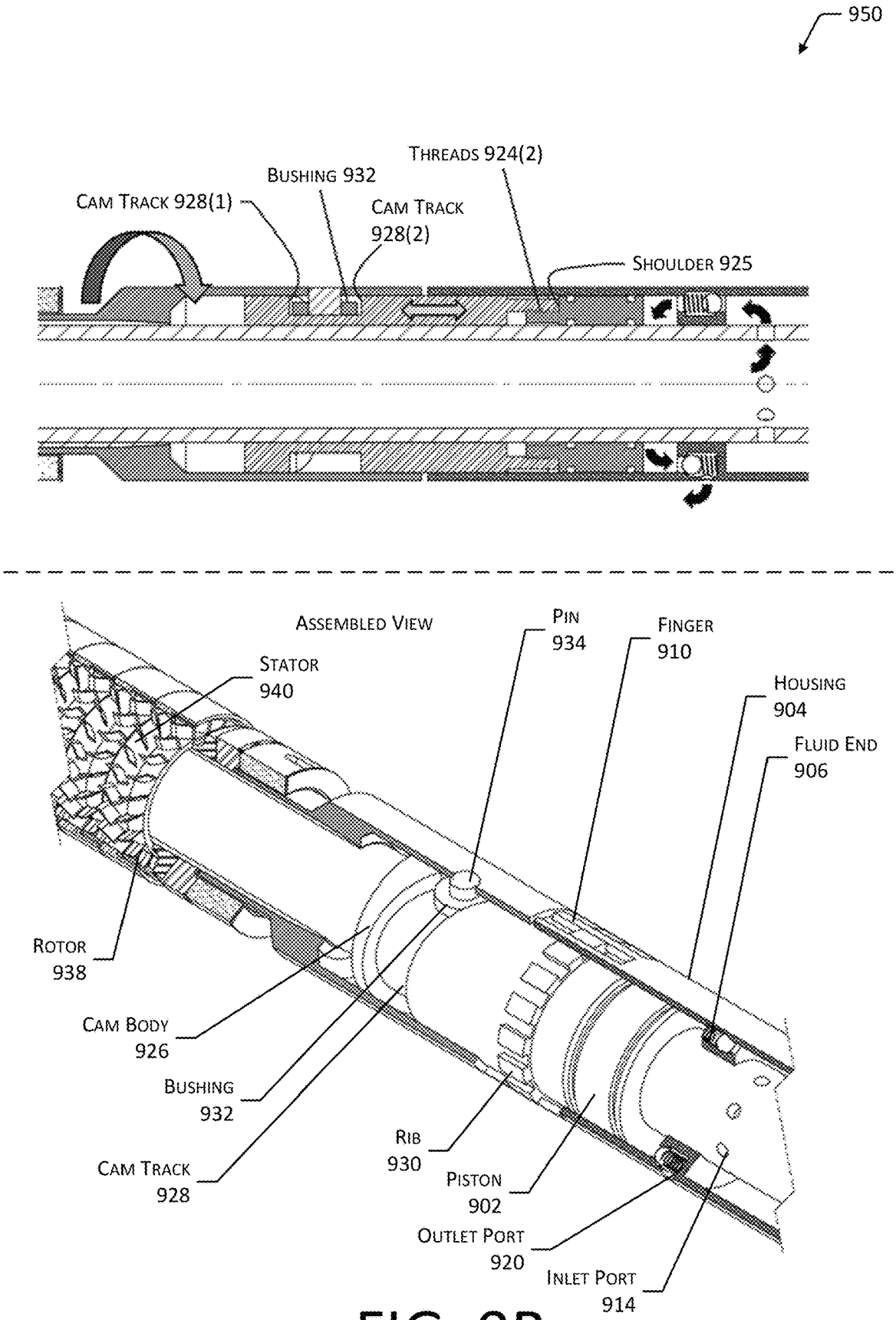
FIG. 9B is a series of diagrams depicting a side cross-sectional view and an assembled view of the pump of FIG. 9A.

FIG. 9B is a series of diagrams 950 depicting a side, cross-sectional view and an assembled view of the pump of FIG. 9A. In operation, the pump turbine may cause the turbine coupling 936 to rotate, causing the bushing 932 to orbit on a plate about the central axis of the pump. The bushing 932 may engage the faces of the cam track 928(1) and 928(2), which may cause the cam body 926 to reciprocate. Because the cam body 926 is connected to the shoulder 925 and annular piston 902, the piston 902 may reciprocate as well. When an endcap 202 has been placed in the launch tube 418, isolating the launch tube 418 from the borehole environment, the pump may apply suction to the launch tube 418 and breech tube 416, expelling gas or fluid from the launch tube 418 and breech tube 416 into an adjacent annulus 122(1).

In some implementations, the reciprocating motion of the cam body 926 may be used to impart motion to other components of the system. For example, an impact-drilling mechanism may be engaged with the cam body 926 using one or more conduits 104 or other connectors, such that axial movement of the cam body 926 may cause the mechanism to contact and break or displace geologic material, debris, and so forth.

Figure 10:
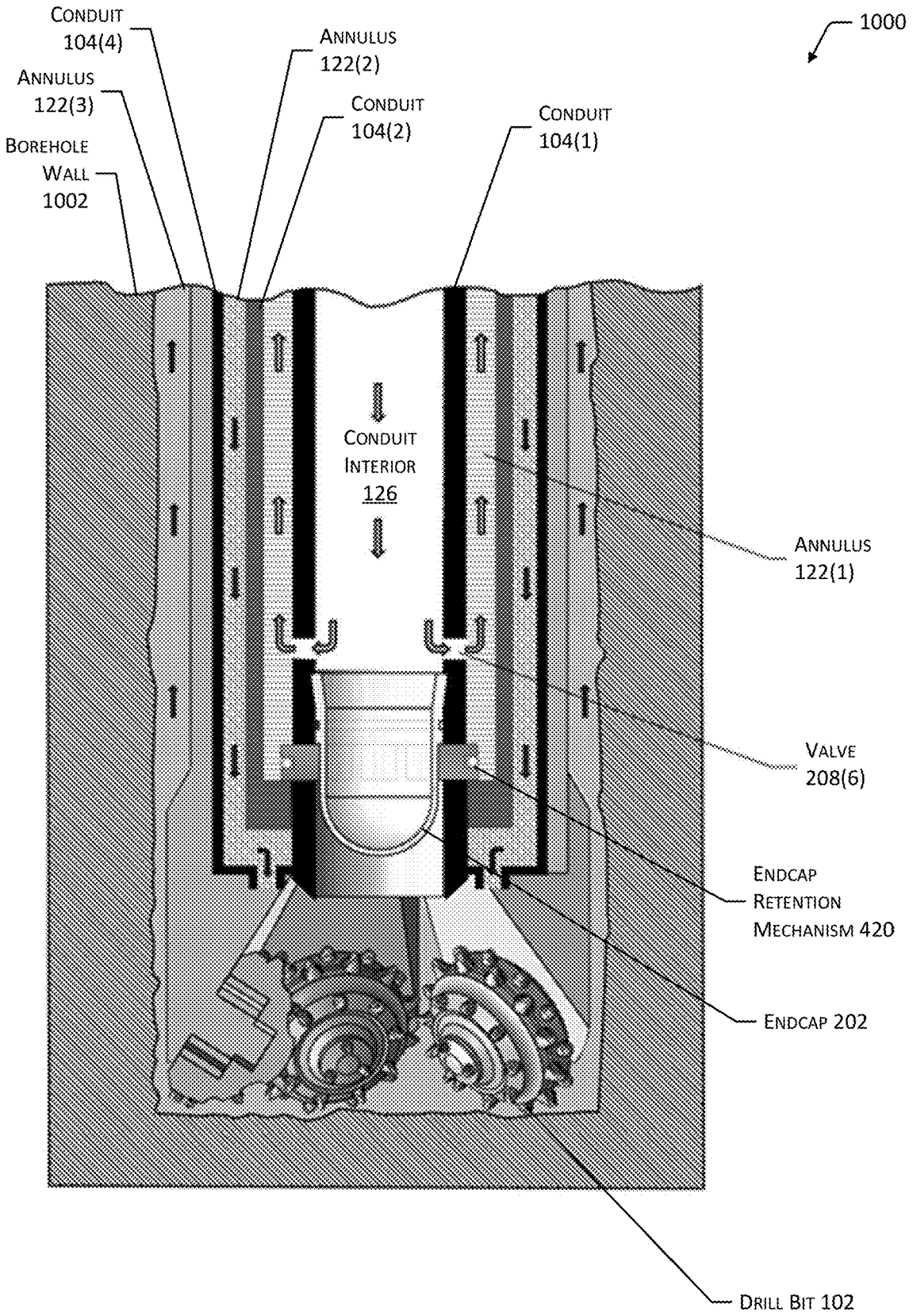
FIG. 10 is a diagram depicting a diagrammatic cross-sectional view of a conduit string that includes three conduits and associated annuli that may be used to provide gas, endcaps, projectiles, and fluid into a borehole and circulate gas, fluid, and debris toward the surface of the borehole.

FIG. 10 is a diagram 1000 depicting a diagrammatic cross-sectional view of a conduit string that includes three conduits 104 and associated annuli 122 that may be used to provide gas, endcaps 202, projectiles 204, and fluid into a borehole and circulate gas, fluid, and debris toward the surface of the borehole. A first conduit 104(1) may be positioned generally concentrically within a second conduit 104(2), such that a first annulus 122(1) is defined between the first conduit 104(1) and the second conduit 104(2). A third conduit 104(4) may be positioned generally concentrically around the second conduit 104(2), defining a second annulus 122(2) between the second conduit 104(2) and the third conduit 104(4). A third annulus 122(3) may be defined between the outer diameter of the third conduit 104(4) and the borehole wall 1002.

As described previously, an endcap 202 may be provided into the first conduit 104(1) and may move through the conduit interior 126 using air or another gas provided into the first conduit 104(1). The endcap 202 may contact an endcap retention mechanism 420 in a portion of the first conduit 104(1) that includes a launch tube 418. The endcap 202 may isolate the conduit interior 126 from the borehole environment. As described with regard to FIG. 8, a projectile 204 may be positioned within the breech tube 416 of the first conduit 104(1), and a valve 208 may isolate the breech tube 416 and launch tube 418 from portions of the first conduit 104(1) located above the breech tube 416. At least a portion of the gas within the conduit interior 126 may be evacuated into the adjacent first annulus 122(1) using one or more valves 208(6). For example, the first annulus 122(1) may communicate with the surface of the borehole, and establishing communication between the surface and the conduit interior 126 by opening the valve(s) 208(6) may equalize the conduit interior 126 with the pressure at the borehole surface.

In some implementations, an additional conduit 104(3) may be positioned within the first annulus 122(1) and used to provide propellant material into the breech tube 416. For example, after evacuation of the breech tube 416 and launch tube 418 by moving gas through the valve(s) 208(6), propellant material and air for combustion may be used to cause a combustion reaction that applies a force to the projectile 204, accelerating the projectile 204 through the launch tube 418. The projectile 204 may penetrate through the endcap 202, pass through an opening in the drill bit 102, and contact geologic material. The drill bit 102 may then be operated to bore through the geologic material contacted by the projectile 204.

Water, drilling fluid, or another fluid may be provided into the second annulus 122(2). The provided fluid may exit the conduit string through one or more ports, nozzles, or other types of openings at or near the drill bit 102, and may contact the drill bit 102, such as to cool and lubricate the drill bit 102. The fluid may then circulate from the bottom of the borehole toward the surface via the third annulus 122(3).

Interactions between the projectile 204 and the endcap 202, between the projectile 204 and the geologic material, and between the drill bit 102 and the geologic material may create debris, such as cuttings, broken rock, bored earth, pieces of the projectile or endcap, and so forth. In some implementations, this debris may be displaced from the bottom of the borehole and moved toward the surface, such as through the third annulus 122(3), by providing air or another gas through the conduit interior 126. After the projectile 204 has been accelerated and has penetrated through the endcap 202, the air or other gas may pass through the open end of the launch tube 418 and displace debris from the bottom of the borehole. The displaced debris may be carried toward the surface through the third annulus 122(3). In some implementations, portions of the debris may be circulated toward the surface through the first annulus 122(1).

In addition to or in place of the use of gas to displace debris, fluid provided into the borehole through the second annulus 122(2) may displace the debris. For example, some debris may have a weight, density, or other characteristics that limit movement of the debris using air. In such a case, use of water, drilling mud, or another fluid may more effectively displace the debris. Debris displaced by fluid provided through the second annulus 122(2) may be circulated toward the surface in the third annulus 122(3).

As such, the first annulus 122(1) may function as a vent passage that may be used to remove gas from the launch tube 418 and breech tube 416 in addition to or in place of a pump, such as the pump shown in FIGS. 9A and 9B. While FIG. 10 depicts an embodiment in which the first annulus 122(1) is used to remove gas from the launch tube 418 and breech tube 416, in other implementations any of the annuli 122 may be used. For example, the first annulus 122(1) may connect, through the swivel 106, to atmospheric pressure at the borehole surface.

When an endcap 202 is moved into the launch tube 418 using pressurized air or another agar, the seal provided by the endcap 202 in combination with the gas provided into the breech tube 416 and launch tube 418 may cause the breech tube 416 and launch tube 418 to have a pressure greater than that of fluid pressure near the drill bit 102, and greater than an optimal pressure for acceleration of a projectile 204. The airlock 206 valve located upstream of the breech tube 416 may be closed, then pressure within the breech tube 416 and launch tube 418 may be released into the adjacent annulus 122(1) by opening the valve(s) 208(6). For example, the valve 208(6) may include a three-wave ball valve with one port connected to the swivel 106, another port connected to the gas passage 504, and another port venting to the atmosphere external to the conduit 104(1). When the valve 208 is used to send gas to the external atmosphere, pressure in the launch tube 418 and breech tube 416 may be reduced to approximately atmospheric pressure, creating an environment within the breech tube 416 and launch tube 418 that is conducive to acceleration of a projectile 204.

Figure 11A:
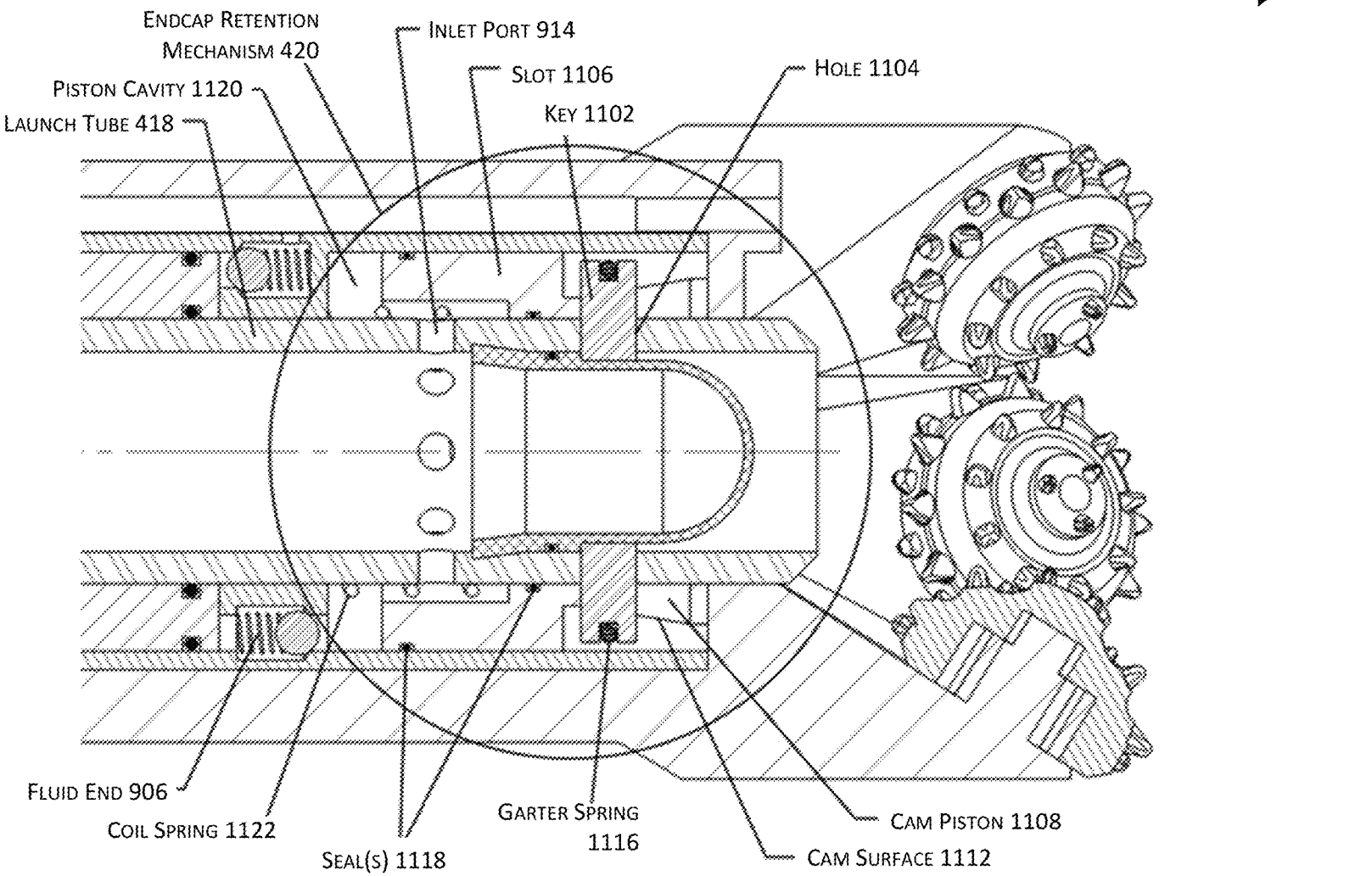
FIG. 11A is a diagram depicting a side cross-sectional view of an implementation of an endcap retention mechanism used to retain an endcap within a conduit.

FIG. 11A is a diagram 1100 depicting a side cross-sectional view of an implementation of an endcap retention mechanism 420 used to retain an endcap 202 within a conduit 104(1). The endcap retention mechanism 420 may be used to limit movement of endcaps 202 within the launch tube 418 by use of one or more keys 1102, or other members that may be movable from a first position that protrudes into the interior of the launch tube 418 to prevent passage of an endcap 202, and a second position that does not protrude into the launch tube 418 or that may protrude less than when in the first position. For example, the endcap retention mechanism 420 may be positioned near the distal end of the launch tube 418. As an endcap 202 is moved through the launch tube 418 using the flow of gas, pressure upstream from the endcap 202 may exceed pressure downstream of the endcap 202. The endcap retention mechanism 420 may prevent the endcap 202 from moving out of the distal end of the launch tube 418 through use of the keys 1102 that may protrude from one or more radially-directed holes 1104 in the launch tube 418. After the endcap 202 has been positioned within the launch tube 418, the keys 1102 may be withdrawn from the first position, such as by translating radially to the second position in which the interior of the launch tube 418 is not blocked, or is blocked less than when in the first position. The keys 1102 may extend inwardly through slots 1106 in a cam piston 1108.

Figure 11B:
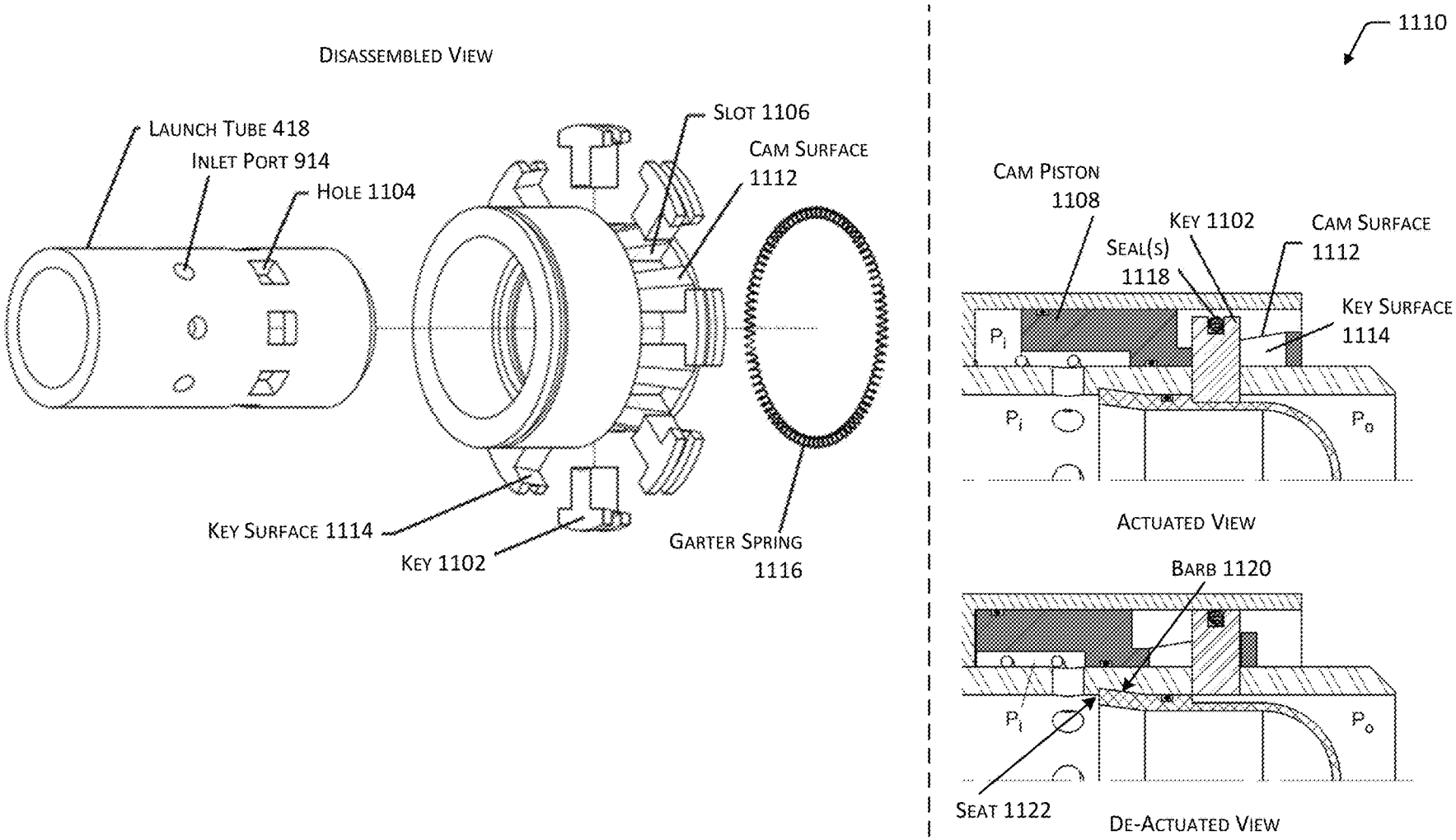
FIG. 11B is a series of diagrams depicting a disassembled view and diagrammatic side cross-sectional views of the endcap retention mechanism of FIG. 11A.

FIG. 11B is a series of diagrams 1110 depicting a disassembled view and diagrammatic side cross-sectional views of the endcap retention mechanism 420 of FIG. 11A. The cam piston 1108 may have angled cam surfaces 1112 that mate with angled key surfaces 1114 that extend from the keys 1102. The keys 1102 may be biased inwardly by a garter spring 1116 or other type of biasing member.

As the cam piston 1108 moves upward, the keys 1102 are forced outward toward the second position. The cam piston 1108 may have an annular configuration having seals 1118 on an inner and outer diameter thereof. The seals 1118 in combination with the body of the cam piston 1108 may form a piston cavity 1120 that may connect through inlet ports 914 to the launch tube 418. In some implementations, if the pump shown in FIG. 9 is used, the piston cavity 1120 may also connect to the fluid end 906 of the pump. The cam piston 1108 may be biased downward using a coil spring 1122 or another type of biasing member.

In operation, after a projectile 204 has been acerated out of the launch tube 418, borehole fluid, debris, and so forth may enter the launch tube 418, equalizing pressure in the launch tube 418 and breech tube 416, as well as that of the piston cavity 1120, with the borehole environment. For example, the inlet ports 914 in the launch tube 418 may connect to the cam piston cavity 1120, so pressure may be the same on both sides of the cam piston 1108. In such a case, the net hydraulic force on the cam piston 1108 may be near zero. Therefore, the primary force applied to the cam piston 1108 may be a biasing force from the coil spring 1122, which may urge the cam piston 1108 downward. When the cam piston 1108 is in a downward position, the keys 1102 may be moved toward the interior of the launch tube 418 by the biasing force of the garter spring 1116, or other type of biasing member.

A valve 208(7) may be opened to allow gas into the breech tube 416 and launch tube 418, or alternatively, a valve 208(8) may be opened to flow drilling fluid into the breech tube 416 and launch tube 418. The gas or fluid may flush debris or borehole fluid from within the breech tube 416 and launch tube 418. A subsequent endcap 202 may then be released into the breech tube 416, such as by opening an airlock valve 208(5). Gas that flows through the airlock valve 208(5) may move the endcap 202 until the endcap 202 seats against the shoulders provided by the extended keys 1102. In some implementations, a sensor may be used to determine that the endcap 202 has contacted the keys 1102 or reached a selected position. For example, a pressure sensor may be used to sense an increase in pressure that may occur after the endcap 202 isolates the launch tube 418 from the borehole environment. For example, seating the endcap 202 may create a sealed cavity that includes the breech tube 416, launch tube 418, and piston cavity 1120.

When pressure is reduced in the breech tube 416 and launch tube 418, such as through operation of a pump as shown in FIG. 9, or venting gas into an annulus 122(1) using one or more valves 208(6), the cam piston 1108 may travel upward, in turn providing a force to the keys 1102 to drive the keys outward from the interior of the launch tube 418. In such a situation, pressure below the endcap 202 may be greater than that above it, providing an upward force to the endcap 202. The endcap 202 may include one or more barbed ridges on an outer diameter thereof, or another type of feature that may expand into a groove in the launch tube 418 having a complementary or similar shape. The endcap 202 may include an O-ring or other type of sealing member on the outer diameter thereof, which may create a seal within the bore of the launch tube 418, enabling a lower-pressure (e.g., at least partially evacuated) environment to be created in the launch tube 418 and breech tube 416 upstream of the endcap 202.

After moving the keys 1102 outward from the endcap 202, acceleration of a projectile 204 through the launch tube 418 may provide a force to the endcap 202 to remove the endcap 202 from the end of the launch tube 418. In some cases, the projectile 204 may penetrate, break, or otherwise degrade the endcap 202. In other implementations, gas provided into the breech tube 416 or launch tube 418 may displace the endcap 202 prior to contact from a projectile 204. For example, gas having sufficient pressure may cause the endcap 202 to be displaced out from the end of the launch tube 418 into the borehole environment. The gas may then exit the end of the launch tube 418 to occupy a region of the borehole proximate to the end of the launch tube 418. For example, if the borehole is filled with water or another fluid, the presence of the gas proximate to the end of the launch tube 418 may displace the fluid, creating a pocket of gas through which the accelerated projectile 204 may pass to interact with the geologic material in front of the launch tube 418. In other implementations, gas may be provided to a region of the borehole in front of the end of the launch tube 418, in conjunction with removal of the endcap 202 or independent of the removal of the endcap 202, using other mechanisms such as valves 208, conduits 104, and so forth, that are oriented to communicate the gas toward the end of the launch tube 418. Displacement of water or other fluid from the region in front of the launch tube 418 may reduce the impedance on the movement of the projectile 202 that may be caused by the water or other fluid. Additionally, as the water or other fluid returns to the region in front of the launch tube 418, this force caused by the movement of the fluid may further break, degrade, or displace geologic material or debris.

Figure 11C:
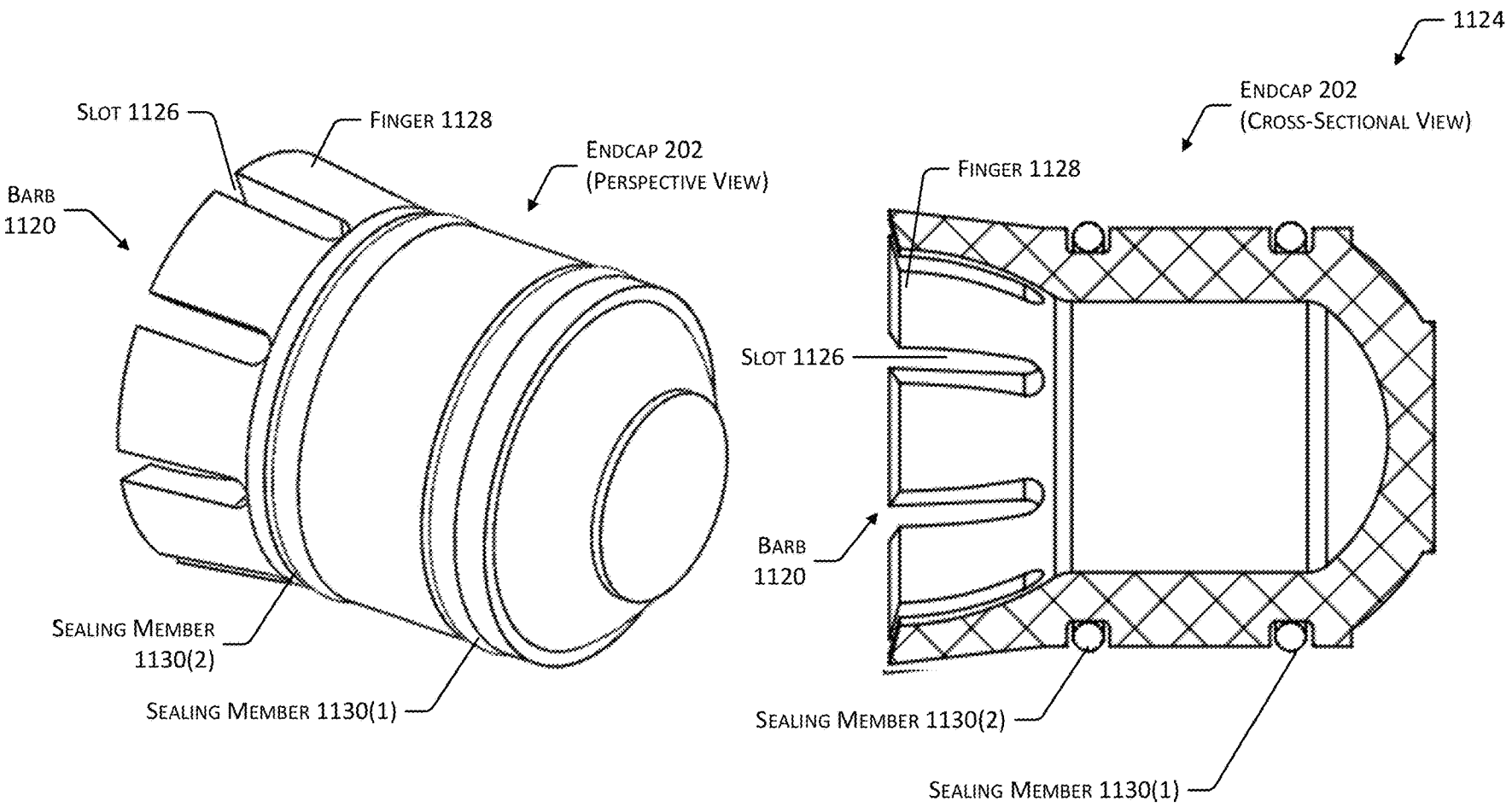
FIG. 11C is a series of diagrams depicting a perspective view and cross-sectional view of an implementation of an endcap.

In some implementations, the endcap 202 may include a barb 1120 region that may secure the endcap 202 within the launch tube 418 at a corresponding seat 1122. For example, FIG. 11C is a series of diagrams 1124 depicting a perspective view and cross-sectional view of an implementation of an endcap 202. As shown in FIG. 11C, the barb 1120 region may include one or more longitudinal slots 1126 within the endcap 202, forming separate fingers 1128. The separation between the fingers 1128 due to the slots 1126 may enable the fingers 1128 to be radially compressed (e.g., deflected) as the endcap 202 is moved through the launch tube 418. For example, the launch tube 418 may have an inner diameter that is smaller than the external diameter of the barb 1120 region of the endcap 202. The fingers 1128 of the barb 1120 region may be deflected by contact with the inner diameter of the launch tube 418 enabling the endcap 202 to pass through the launch tube 418 toward the seat 1122. When the endcap 202 reaches the seat 1122, which may have a larger diameter than the inner diameter of the launch tube 418, the fingers 1128 of the barb 1120 region may be biased outward to retain the endcap 202 at the location of the seat 1122.

In some implementations, the endcap 202 may also include multiple sealing members 1130 that may form a seal against the inner diameter of the launch tube 418 to prevent the passage of air or other fluids around the endcap 202 while the endcap 202 passes through the launch tube 418. A first sealing member 1130(1) may be placed along the body of the endcap 202, spaced a distance from a second sealing member 1130(2). The spacing of the sealing members 1130 may enable the portion of the endcap 202 that is between the first sealing member 1130(1) and second sealing member 1130(2) to span the seat 1122, a port or valve, or another feature within the launch tube 418. For example, when the first sealing member 1130(1) passes the seat 1122 during movement of the endcap 202 through the launch tube 418, the second sealing member 1130(2) may remain in contact with the inner diameter of the launch tube 418 to prevent movement of fluid past the endcap 202. Before the second sealing member 1130(2) reaches the position of the seat 1122, the first sealing member 1130(1) may pass the location of the seat 1122 and contact the inner diameter of the launch tube 418 located downhole from the seat 1122, forming a seal. As a result, at least one sealing member 1130 remains in contact with the inner diameter of the launch tube 418 while the endcap 202 moves past features within the launch tube 418, preventing the movement of fluid past the endcap 202.

Figure 12A:
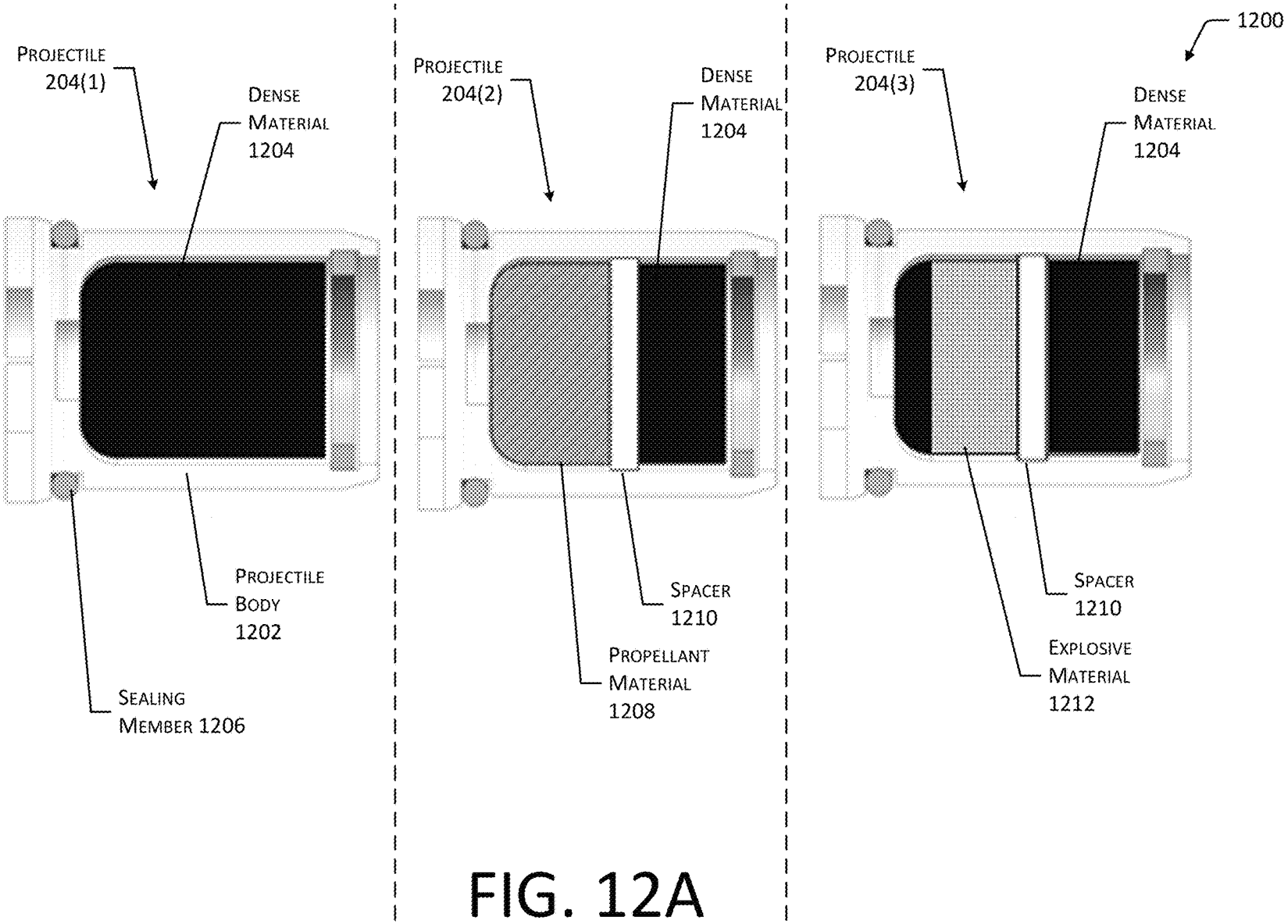
FIGS. 12A-12C are a series of diagrams depicting implementations of projectiles that may be used to interact with geologic material.

FIGS. 12A-2C are a series of diagrams 1200 depicting implementations of projectiles 204 that may be used to interact with geologic material. In some implementations, a projectile 204(1) may include a projectile body 1202 that encloses primarily dense material 1204. Example dense materials 1204 may include granite, a composite such as barite or metallic grains, such as hematite or itabirite. In some implementations, dense material 1204 may include metallic powders bonded by cement or an organic or inorganic binder, or by a sintering process. In some cases, the projectile body 1202 may include a different material, such as a frangible or degradable material. In other implementations, the projectile body 1202 may include the dense material 1204. A sealing member 1206 associated with the projectile body 1202 may provide a sealing engagement between the projectile 204 and the inner diameter of the breech tube 416 or launch tube 418. The sealing member 1206 may retain the projectile 204 in a selected position until pressure from propellant material behind the projectile 204 is sufficient to overcome the sealing force, accelerating the projectile 204 through the launch tube 418.

While implementations discussed previously describe providing gas, propellant material, and fluid into a breech tube 416 or launch tube 418, such as through use of one or more conduits 104, in other implementations, one or more of these components may be included within the projectile 204.

For example, FIG. 12A depicts a projectile 204(2) that includes propellant material 1208 integrated within the projectile body 1202. For example, upon breakage or degradation of the projectile body 1202 in response to pressure, temperature, impact, or other conditions, the propellant material 1208 within the projectile body 1202 may provide a force to the projectile 204 to accelerate the projectile 204 through the launch tube 418. A spacer 1210 may separate dense material 1204 within the projectile 204 from integrated propellant material 1208.

In another implementation shown in FIG. 12A, a projectile 204(3) may include explosive material 1212 integrated within the projectile body 1202. A spacer 1210 may separate the explosive material 1212 from dense material 1204. In one implementation, integrated explosive material 1212 may include ammonium nitrate fuel oil (AND), which has a high shock detonation threshold and is unlikely to detonate during normal handling, conveyance, or transport downhole, but may detonate in response to high shock pressure resulting from an impact between the projectile 204 and geologic material. For example, an impact velocity of 700 m/s or greater may cause the explosive material 1212 to detonate upon impact. In some implementations, the explosive material 1212 may include a shaped charge, enabling energy from an explosion to be directed in a preferred orientation, such as to maximize hard rock broken by the explosion. For example, a projectile 204 that includes detonable or explosive material 1212 may create a greater zone of damaged geologic material when compared to a projectile 204 that lacks explosive material 1212. In some implementations, the body or shell of the projectile 204 may be formed from dense material 1204 to protect explosive material 1212 from detonation until an impact sufficient to break the body or shell of the projectile 204 occurs.

In some implementations, the types of projectiles 204 used to extend a borehole may be varied. For example, a projectile 204 including explosive material 1212 may be accelerated in alternating fashion with a projectile 204 that includes primarily dense material 1204 and lacks explosive material 1212. As another example, two projectiles 204 that lack explosive material 1212 may be accelerated after each projectile 204 that includes explosive material 1212. The sequence of projectiles 204 that are accelerated may be selected based on characteristics of the geologic material such as composition or hardness, borehole conditions such as depth or pressure, and so forth.

Figure 12B:
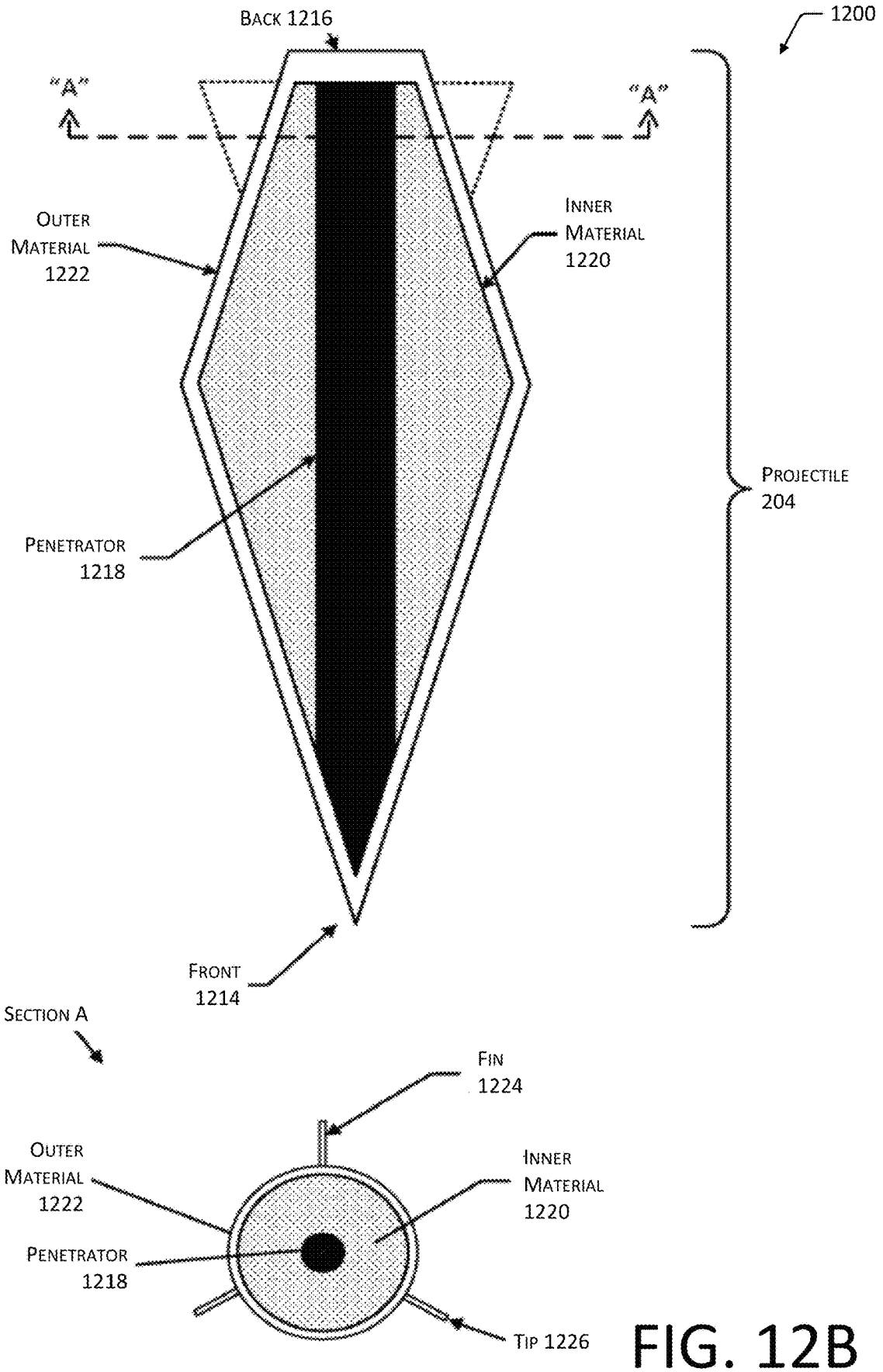

FIG. 12B depicts a side cross-sectional view and an end cross-sectional view of an implementation of a projectile 204 having a tapered front 1214. In some cases, the projectile 204 shown in FIG. 12B may be accelerated using ram effects between features of the projectile 204 and features of the launch tube 418, enabling the launch tube 418 to function as a ram accelerator. The projectile 204 may have a truncated or flat back 1216. The projectile 204 may include an internal rod penetrator 1218 that may be formed from steel or other dense materials 1204, such as ceramic, plastic, and so forth. In some implementations, the rod penetrator 1218 may include copper, depleted uranium, and so forth. The projectile 204 may include an inner material 1220 within the body, and an outer material 1222 such as a dense shell. In some implementations, the inner material 1220 may include a solid plastic material or other material to entrain within a borehole, such as explosives, hole cleaner, seepage stop, water, or ice. In some implementations, a plastic explosive or specialized explosive may be embedded in the rod penetrator 1218. As the projectile 204 interacts with geologic material, explosive material 1212 may be entrained into the borehole, where it may be detonated. In another embodiment, the outer material 1222 may include a shell or body that is connected to a lanyard train configured to pull a separate explosive into the borehole. In some implementations, at least a portion of the projectile 204 may include a material that is combustible during conditions present during acceleration of the projectile 204. For example, the outer material 1222 may include aluminum. In some implementations, the projectile 204 may omit onboard propellant material.

In some implementations, the back 1216 of the projectile 204 may include an obturator to prevent the escape of the air or propellant material as the projectile 204 accelerates through the launch tube 418. The obturator may be an integral part of the projectile 204 or a separate and detachable unit.

The projectile 204 may also include one or more fins 1224, rails, or other guidance features. For example, the projectile 204 may be rifled to induce spiraling. The fins 1224 may be positioned toward the front 1214 of the projectile 204, the back 1216, or both, to provide guidance during acceleration. In some implementations, the body of the projectile 204 may extend outward to form a fin or other guidance feature. In some implementations, the fins 1224 may be coated with an abrasive material that aids in cleaning the launch tube 418 as the projectile 204 moves therein. For example, one or more of the fins 1224 may include an abrasive tip 1226.

In some implementations the projectile 204 may incorporate one or more sensors or other instrumentation. The sensors may include accelerometers, temperature sensors, gyroscopes, and so forth. Information from these sensors may be returned to receiving equipment using radio frequencies, optical transmission, acoustic transmission, and so forth. This information may be used to modify one or more firing parameters, characterize material in the borehole, and so forth.

Figure 12C:
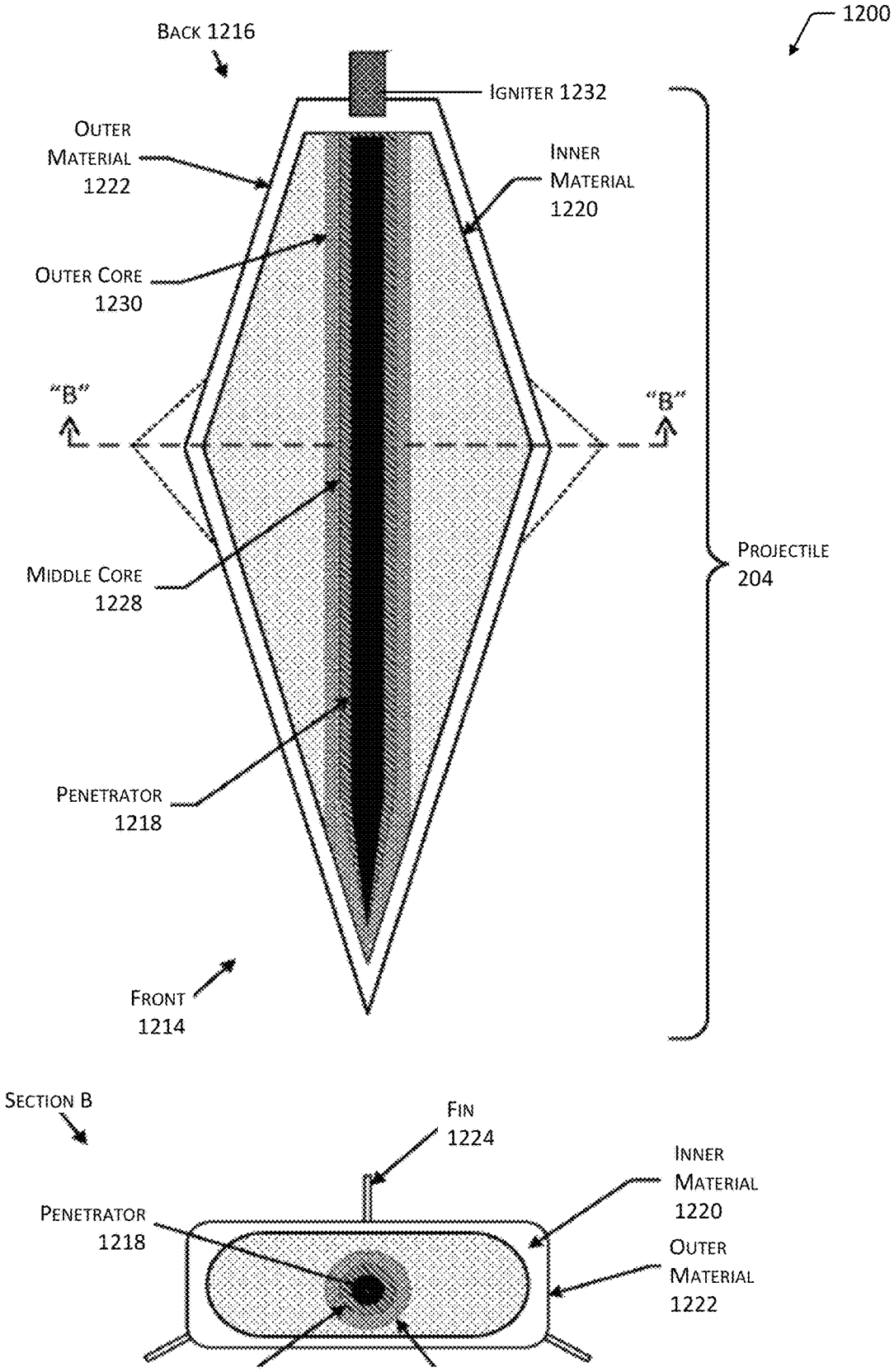

FIG. 12C depicts a side cross-sectional view and an end cross-sectional view of an implementation of a projectile 204 having a tapered front 1214 and a rectangular cross-sectional shape. A rod penetrator 1218 extends between the front 1214 and back 1216 of the projectile 204. While the penetrator 1218 is depicted as a rod, in other implementations the penetrator may have one or more other shapes, such as a prismatic solid.

The projectile 204 may include a middle core 1228 and an outer core 1230 proximate to the penetrator 1218. In some implementations one or both of the middle core 1228 or other core 1230 may be omitted. As described above, the projectile 204 may include a body having an inner material 1220 surrounding the core and an outer material 1222 surrounding the inner material 1220.

In some implementations, the projectile 204 may include a pyrotechnic igniter 1232. The pyrotechnic igniter 1232 may be configured to initiate, maintain, or otherwise support combustion of the propellant material to accelerate the projectile 204.

As shown in FIG. 12C, in some implementations, the projectile 204 may not have a radially symmetrical shape. For example, the shape of the projectile 204 may be configured to provide guidance or direction to the projectile 204. Continuing the example, the projectile 204 may have a wedge or chisel shape. As described with regard to FIG. 12B, the projectile 204 may also comprise one or more fins 1224, rails, or other guidance features.

In some implementations, the projectile 204 may include one or more abrasive materials. The abrasive materials may be arranged within or on the projectile 204 and may provide an abrasive action upon impact with geologic material 106. The abrasive materials may include materials such as diamond, garnet, silicon carbide, tungsten, copper, and so forth. For example, the middle core 1228 may include an abrasive material that may be layered between the penetrator 1218 and the outer core 1230.

Figure 13:
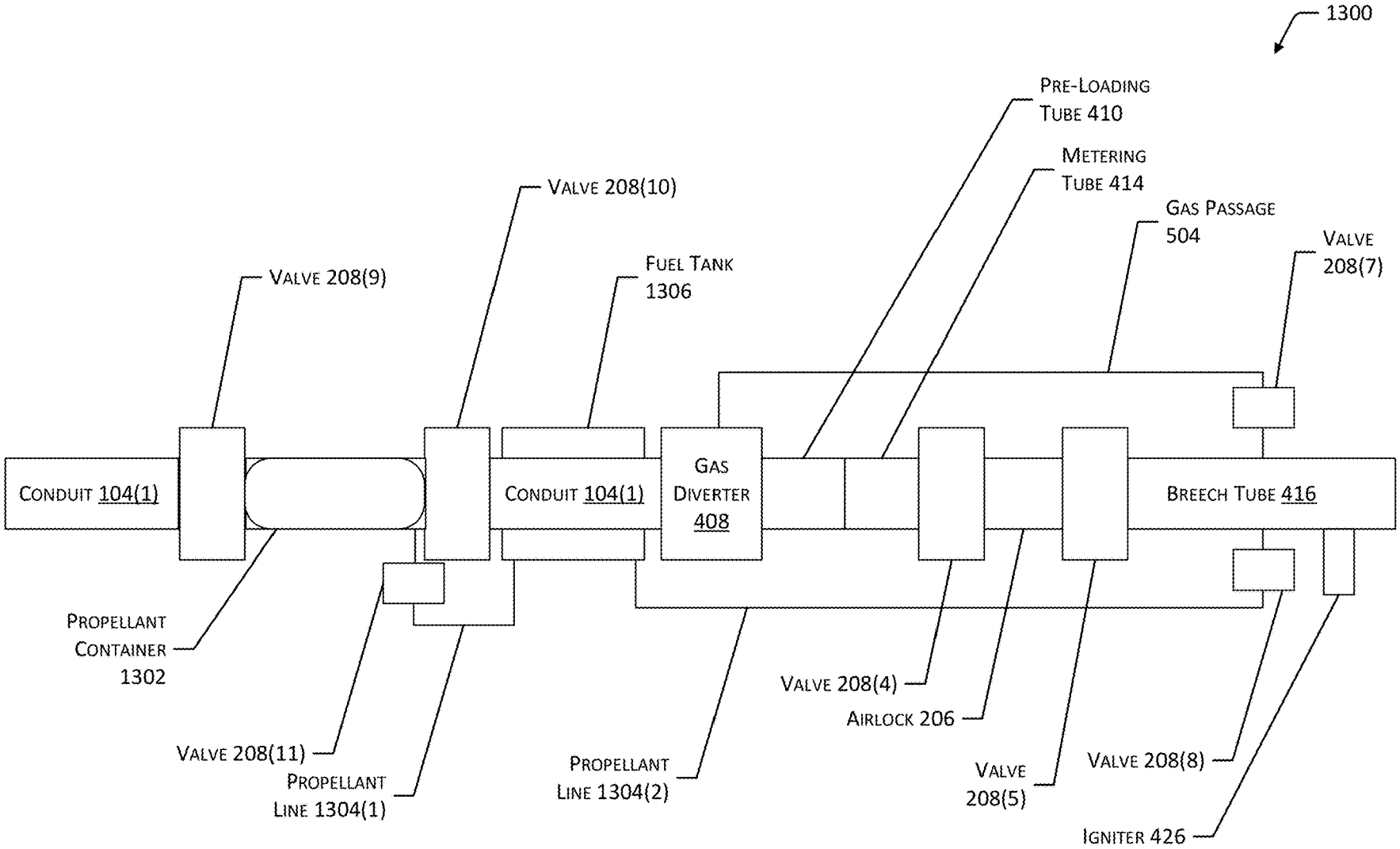
FIG. 13 is a diagram depicting an implementation of a system that may include sources of propellant material that may be located downhole within the system.

FIG. 13 is a diagram 1300 depicting an implementation of a system that may include sources of propellant material that may be located downhole within the system. While previous implementations include transport of propellant material using one or more conduits 104, in other implementations, propellant material may be conveyed through the conduit 104(1) in a canister or other container, the volume of propellant material in the container including sufficient material to accelerate a projectile 204. In the implementation shown in FIG. 13, propellant material may be resupplied intermittently, stored in a system for retaining compressed liquid fuels or other propellant materials, such as a propellant container 1302. For example, a propellant container 1302 may be proximate to or stored in association with a BHA 114. Continuing the example, compressed liquid fuels, such as propane, butane, or other types of propellant material, may be provided down the conduit 104(1) into the propellant container 1302. The propellant container 1302 may include an upper valve 208(9) and lower valve 208(10), forming a propellant lock aligned with the conduit 104(1). An additional valve 208(11) may connect to a bypass passage, such as a propellant line 1304(1), that may connect to an annular fuel tank 1306 downstream of the propellant container 1302.

To refuel the system, the lower valve 208(10) may be closed and a propellant container 1302 may be provided into the conduit 104(1) to land on the lower valve 208(10) or another structural member that may extend into the interior of the conduit 104(1). The upper valve 208(9) may then be closed to form a propellant lock about the propellant container 1302, and the propellant container 1302 may be punctured by a mechanism or otherwise opened, to enable propellant material to be flowed into the fuel tank 1306 via the propellant line 1304(1). After the propellant material has flowed from the propellant container 1302 into the fuel tank 1306, the lower valve 208(11) may be opened, and the propellant container 1302 may be allowed to pass through the conduit 104(1) to the bottom of the borehole. The propellant container 1302 may be formed from materials that may be destroyed by projectiles 204 or the drill bit 102.

A propellant container 1302 may carry sufficient propellant material to accelerate multiple projectiles 204, such as one hundred projectiles 204 or more. When endcaps 202 and projectiles 204 are passed through the conduit 104(1), the valves 208 on either side of the portion that receives the propellant container 1302 may be opened, and the propellant lock may function as an additional portion of the conduit 104(1). A projectile 204 may be accelerated by providing propellant material from the fuel tank 1306 to the breech tube 416, via a propellant line 1304(2) controlled by a valve 208(8). Air or another gas may be provided into the breech tube 416 at or near the time that the propellant material is provided to facilitate mixing of the gas with the propellant material. In cases where the propellant material includes compressed liquid fuel, the lower downstream pressure may enable the compressed liquid fuel to decompress and gasify as it enters the breech tube 416.

While implementations described herein use projectile impacts and a drill bit 102 to extend a borehole, other implementations may include use of projectiles 204 without use of a drill bit 102. For example, successive projectile impacts may pulverize rock and other geologic material, while fluid or gas may be used to remove the debris from the bottom of a borehole. In other implementations, impact-based drilling techniques, such as a pile driver, may be used. For example, an axial or rotational hammer may be used to form a borehole, reducing or eliminating use of traditional rotational energy downhole and the need for large drilling rigs that are used to deliver torque and weight to drill bits 102.

Although certain steps have been described as being performed by certain devices, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific embodiments and implementations, various changes and modifications may be suggested to one skilled in the art and it is intended that the present disclosure encompass such changes and modifications that fall within the scope of the appended claims.

The material included in the following Appendices is included in this disclosure in its entirety.

What is claimed is:

1. A system comprising:

a first conduit having: a first end oriented toward geologic material; and a second end;

a source of gas connected to the second end of the first conduit;

a second conduit positioned around the first conduit, wherein a first annulus is between the first conduit and the second conduit;

a first valve that is movable to separate an interior of the first conduit from the first annulus to enable a gas to flow from the interior to the first annulus;

a first endcap positionable between the interior and the geologic material, wherein the first endcap is configured to separate the interior from an environment external to the first conduit;

a first projectile positionable within the interior, wherein the first projectile is configured for acceleration toward the first end to contact a portion of the geologic material; and a third conduit associated with a source of material, wherein a material from the source of material is provided from the source of material toward the geologic material.

2. The system of claim 1, further comprising:

a drill bit positioned at the first end of the first conduit, wherein:

the drill bit is oriented to contact the geologic material;

the third conduit is positioned around the second conduit;

a second annulus is between the second conduit and the third conduit;

the source of material comprises a fluid source connected to the third conduit; and the fluid source is configured to provide a fluid into the second annulus to contact the drill bit and displace debris formed by interaction between the geologic material and one or more of the first projectile or the drill bit.

3. The system of claim 1, further comprising:

a second valve between the first projectile and the source of gas;

wherein the gas from the source of gas that is provided into the interior of the first conduit positions the first endcap between the interior and the geologic material; wherein the gas from the source of gas positions the first projectile within the interior; and wherein the second valve is closed and the first valve is opened to at least partially evacuate the gas from the interior into the first annulus.

4. The system of claim 1, wherein:

one or more of the first projectile or gas within the first conduit displaces the first endcap before the first projectile contacts the portion of the geologic material, and wherein displacing of the first endcap places the interior of the first conduit in communication with the environment external to the first conduit;

an interaction between the first projectile and the portion of the geologic material forms debris; and the gas from the source of gas provided through the interior of the first conduit toward the first end displaces the debris into a second annulus outside of the second conduit.

5. The system of claim 1, further comprising:

a first member that is movable between: a first position that extends at least partially into the interior of the first conduit; and a second position;

wherein the first endcap is positioned between the interior and the geologic material by contacting the first endcap with the first member in the first position; and wherein the first member is moved to the second position after contact between the first endcap and the first member.

6. The system of claim 1, wherein:

the third conduit is positioned within the first annulus;

the third conduit includes: a third end connected to the interior of the first conduit; and a fourth end;

the source of material comprises a source of propellant material connected to the fourth end; and the source of propellant material is configured to provide propellant material through the third conduit into the interior of the first conduit to apply a force to the first projectile to accelerate the first projectile toward the first end.

7. The system of claim 1, further comprising:

a container connected to the second end of the first conduit, wherein the first endcap, the first projectile, a second endcap, and a second projectile are within the container; and wherein the first endcap, the first projectile, the second endcap, and the second projectile are arranged to cause the first endcap to be provided into the interior of the first conduit before the first projectile, the first projectile to be provided into the interior before the second endcap, and the second endcap to be provided into the interior before the second projectile.

8. A system comprising:

a first conduit having: a first end oriented toward geologic material; and a second end;

a first member positioned between a first portion of the first conduit and a second portion of the first conduit, wherein the first member is movable between: a first position that at least partially obstructs an interior of the first conduit; and a second position;

a second member positioned between the first member and the second portion of the first conduit, wherein the second member is movable between: a third position that at least partially obstructs the interior of the first conduit; and a fourth position;

a first endcap positionable within the interior of the first conduit, wherein the first endcap is movable from the first portion of the first conduit to the second portion by moving the first endcap past the first member when the second member is in the third position, and by moving the first endcap past the second member in the fourth position when the first member is in the first position;

a first projectile positionable within the interior, wherein the first projectile is movable from the first portion of the first conduit to the second portion by moving the first projectile past the first member when the second member is in the third position, and by moving the first projectile past the second member in the fourth position when the first member is in the first position;

a source of gas in communication with the first conduit;

one or more first valves positioned between the first portion of the first conduit and the second portion of the first conduit, wherein the one or more first valves are movable to prevent passage of a gas from the source of gas toward the second portion of the first conduit; and an opening in the first conduit for movement of the gas out of the first conduit.

9. The system of claim 8, wherein:

the second member in the third position prevents movement of the first endcap toward the second portion when the first member is in the second position; and the first member in the first position prevents movement of the first projectile toward the second portion when the second member is in the fourth position.

10. The system of claim 8, wherein one or more of:

the first member comprises a second valve configured to at least partially prevent passage of the gas from the source of gas toward the second portion when the first member is in the first position; or the second member comprises a third valve that is configured to at least partially prevent passage of the gas from the source of gas toward the second portion when the second member is in the third position.

11. The system of claim 8, wherein one or more of:

the first member extends from an inner diameter of the first conduit into the interior when in the first position; or the second member extends from the inner diameter of the first conduit into the interior when in the third position.

12. The system of claim 11, wherein one or more of the one or more first valves or one or more second valves are positioned between the second member and the first end of the first conduit and are movable to prevent passage of the gas from the source of gas toward the second portion of the first conduit.

13. The system of claim 8, wherein one or more of:

movement of the first member toward the second position causes movement of the second member toward the third position; or movement of the second member toward the fourth position causes movement of the first member toward the first position.

14. The system of claim 8, wherein:

the opening comprises a passage extending through a wall of the first conduit;

the passage is separated from the interior and extends from a first side of the one or more first valves to a second side of the one or more first valves;

the passage connects the first portion to the second portion; and the system further comprises: a second valve in the passage, wherein the second valve is movable to prevent movement of the gas through the passage.

15. The system of claim 8, further comprising:

an annular pump positioned at the opening that is engaged with the second portion of the first conduit, wherein the annular pump removes the gas from the second portion of the first conduit when at least one of the one or more first valves prevents passage of the gas into the second portion of the first conduit.

16. The system of claim 8, further comprising:

a second conduit positioned around the first conduit, wherein a first annulus is between the first conduit and the second conduit; and a second valve within the opening, wherein the second valve separates the interior of the first conduit from the first annulus and is movable to enable the gas to flow from the interior to the first annulus.

17. The system of claim 8, wherein the second portion of the first conduit comprises: a first inner diameter; and a seat having a second inner diameter greater than the first inner diameter; and wherein the first endcap comprises:

a plurality of fingers at an end of the first endcap, wherein each finger of the plurality of fingers is separated from at least one other finger of the plurality of fingers by at least one slot;

wherein at least one finger of the plurality of fingers is configured to be deflected relative to at least one other finger of the plurality of fingers to provide the first endcap with a first outer diameter that is configured for movement of the first endcap through the second portion of the first conduit having the first inner diameter; and wherein the at least one finger of the plurality of fingers is biased outward from the first endcap to provide the first endcap with a second outer diameter that is greater than the first inner diameter, and wherein the second outer diameter is configured to retain the first endcap at a position within the seat.

18. The system of claim 8, wherein the second portion of the first conduit comprises: a first inner diameter; and a seat having a second inner diameter greater than the first inner diameter, wherein the seat has a first length, and wherein the first endcap comprises:

a first sealing member at a first position on a body of the first endcap; and a second sealing member at a second position on the body of the first endcap;

wherein a distance between the first position and the second position is greater than the first length.

19. A method comprising:

moving an endcap from a first end of a first conduit toward a second end of the first conduit, wherein the second end is oriented toward geologic material, and wherein movement of the endcap toward the second end is limited by a first member within the first conduit that is between the first end and the second end;

moving a projectile from the first end of the first conduit toward the second end, wherein movement of the projectile toward the second end is limited by the endcap;

moving the first member away from an interior of the first conduit;

moving the endcap past the first member, wherein movement of the endcap toward the second end is limited by a second member that is between the first member and the second end;

moving the first member toward the interior, wherein movement of the projectile toward the second end is limited by the first member;

moving the second member away from the interior;

moving the endcap past the second member to a first position within the first conduit, wherein the endcap separates the interior of the first conduit from an environment external to the first conduit;

moving the first member away from the interior and moving the second member toward the interior;

moving the projectile past the first member, wherein movement of the projectile toward the second end is limited by the second member;

moving the second member away from the interior;

moving the projectile past the second member to a second position within the first conduit, wherein the endcap is between the projectile and the second end;

providing a first gas between the first end of the first conduit and the geologic material, wherein the first gas displaces a material between the first end and the geologic material;

providing a propellant material into the first conduit; and accelerating the projectile toward the second end using a force applied by the propellant material, wherein the projectile contacts a portion of the geologic material.

20. The method of claim 19, wherein the endcap and the projectile are moved by providing one or more of the first gas or a second gas into the first conduit, the method further comprising:

after moving the endcap to the first position, removing the one or more of the first gas or the second gas from the interior of the first conduit into an annulus external to the first conduit.

21. The method of claim 19, wherein the projectile passes through the one or more of the first gas or a second gas to contact the portion of the geologic material.

22. The method of claim 19, further comprising:

contacting the portion of the geologic material using a drill bit that is positioned at the second end of the first conduit, wherein an interaction between the geologic material and one or more of the projectile or the drill bit creates debris; and providing a fluid into a first annulus that is between the first conduit and a second conduit that is positioned around the first conduit, wherein the fluid contacts the drill bit and displaces the debris into a second annulus that is external to the second conduit.

23. A system comprising:

a first conduit having a first end and a second end, wherein the first end is oriented toward geologic material;

a source of gas connected to the second end;

a second conduit positioned around the first conduit, wherein a first annulus is between the first conduit and the second conduit;

a first valve that is movable to separate an interior of the first conduit from the first annulus to enable a gas to flow from the interior to the first annulus;

a first endcap positionable between the interior and the geologic material, wherein the first endcap is configured to separate the interior from an environment external to the first conduit;

a first projectile positionable within the interior, wherein the first projectile is configured for acceleration toward the first end to contact a portion of the geologic material; and a second valve between the first projectile and the source of gas, wherein closure of the second valve and opening of the first valve is configured to evacuate the gas from the interior into the first annulus.

24. A system comprising:

a first conduit having a first end and a second end, wherein the first end is oriented toward geologic material;

a source of gas connected to the second end;

a second conduit positioned around the first conduit, wherein a first annulus is between the first conduit and the second conduit;

a first valve that is movable to separate an interior of the first conduit from the first annulus to enable a gas to flow from the interior to the first annulus;

a first endcap positionable between the interior and the geologic material, wherein the first endcap is configured to separate the interior from an environment external to the first conduit;

a first projectile positionable within the interior, wherein the first projectile is configured for acceleration toward the first end to contact a portion of the geologic material; and a container connected to the second end, wherein:

the first endcap, the first projectile, a second endcap, and a second projectile are within the container; and the first endcap, the first projectile, the second endcap, and the second projectile are arranged to cause the first endcap to be provided into the interior before the first projectile, the first projectile to be provided into the interior before the second endcap, and the second endcap to be provided into the interior before the second projectile.

25. A system comprising:

a first conduit having a first end and a second end, wherein the first end is oriented toward geologic material;

a first member positioned between a first portion of the first conduit and a second portion of the first conduit, wherein the first member is movable between: a first position that at least partially obstructs an interior of the first conduit; and a second position;

a second member positioned between the first member and the second portion of the first conduit, wherein the second member is movable between a third position that at least partially obstructs the interior of the first conduit and a fourth position;

a first endcap positionable within the interior of the first conduit, wherein the first endcap is movable from the first portion of the first conduit to the second portion by moving the first endcap past the first member when the first member is in the second position, and by moving the first endcap past the second member when the second member is in the fourth position; and a first projectile positionable within the interior, wherein the first projectile is movable from the first portion of the first conduit to the second portion by moving the first projectile past the first member when the first member is in the second position, and by moving the first projectile past the second member when the second member is in the fourth position;

wherein one or more of:

movement of the first member toward the second position causes movement of the second member toward the third position; or movement of the second member toward the fourth position causes movement of the first member toward the first position.

26. A system comprising:

a first conduit having a first end and a second end, wherein the first end is oriented toward geologic material;

a first member positioned between a first portion of the first conduit and a second portion of the first conduit, wherein the first member is movable between: a first position that at least partially obstructs an interior of the first conduit; and a second position;

a second member positioned between the first member and the second portion of the first conduit, wherein the second member is movable between: a third position that at least partially obstructs the interior of the first conduit; and a fourth position;

a first endcap positionable within the interior of the first conduit, wherein the first endcap is movable from the first portion of the first conduit to the second portion by moving the first endcap past the first member when the first member is in the second position, and by moving the first endcap past the second member when the second member is in the fourth position; and a first projectile positionable within the interior, wherein the first projectile is movable from the first portion of the first conduit to the second portion by moving the first projectile past the first member when the first member is in the second position, and by moving the first projectile past the second member when the second member is in the fourth position;

wherein:

the second portion of the first conduit comprises: a first inner diameter; and a seat having a second inner diameter greater than the first inner diameter; and the first endcap comprises one or more features for engagement with the first conduit.

27. The system of claim 26, wherein the one or more features of the first endcap comprise:

a plurality of fingers at an end of the first endcap, wherein:

each finger of the plurality of fingers is separated from at least one other finger of the plurality of fingers by at least one slot;

at least one finger of the plurality of fingers is configured to be deflected relative to at least one other finger of the plurality of fingers to provide the first endcap with a first outer diameter that is configured for movement of the first endcap through the second portion of the first conduit having the first inner diameter;

the at least one finger of the plurality of fingers is biased outward from the first endcap to provide the first endcap with a second outer diameter that is greater than the first inner diameter; and the second outer diameter is configured to retain the first endcap at a position within the seat.

28. The system of claim 26, wherein the seat has a first length, the first endcap comprising:

a first sealing member at a first position on a body of the first endcap; and a second sealing member at a second position on the body of the first endcap;

wherein a distance between the first position and the second position is greater than the first length.

* * * * *